US008429771B2

(12) United States Patent
Long

(10) Patent No.: US 8,429,771 B2
(45) Date of Patent: Apr. 30, 2013

(54) EASY-ACCESS SAFETY BASSINET

(76) Inventor: Patricia Long, Santa Barbara, CA (US)

( * ) Notice: Subject to any disclaimer, the term of this patent is extended or adjusted under 35 U.S.C. 154(b) by 424 days.

(21) Appl. No.: 12/703,034

(22) Filed: Feb. 9, 2010

(65) Prior Publication Data

US 2010/0199426 A1 Aug. 12, 2010

Related U.S. Application Data

(60) Provisional application No. 61/207,272, filed on Feb. 9, 2009.

(51) Int. Cl.
*A47D 7/02* (2006.01)

(52) U.S. Cl.
USPC ..... 5/100; 5/93.1; 5/655; 5/424; 5/425; 5/428

(58) Field of Classification Search ..... 5/93.1, 5/655, 100, 424, 425, 428; 49/40
See application file for complete search history.

(56) References Cited

U.S. PATENT DOCUMENTS

| | | | | |
|---|---|---|---|---|
| 1,133,429 | A | 3/1915 | Christensen | |
| 2,804,631 | A * | 9/1957 | Levin | 5/100 |
| 3,932,903 | A * | 1/1976 | Adams et al. | 5/100 |
| 3,971,083 | A * | 7/1976 | Peterson | 5/430 |
| 4,706,312 | A * | 11/1987 | Shamie | 5/93.1 |
| 4,811,436 | A * | 3/1989 | Schwartz | 5/93.1 |
| 4,998,939 | A * | 3/1991 | Potthast et al. | 5/424 |
| 5,111,543 | A * | 5/1992 | Epshetsky et al. | 5/424 |
| 5,172,435 | A | 12/1992 | Griffin | |
| 5,430,899 | A | 7/1995 | Chisholm | |
| 5,581,833 | A | 12/1996 | Zenoff | |
| 5,745,936 | A * | 5/1998 | Van McCutchen et al. | 5/600 |
| 5,819,340 | A | 10/1998 | Kelly | |
| 5,970,539 | A * | 10/1999 | McDermott et al. | 5/98.1 |

(Continued)

FOREIGN PATENT DOCUMENTS

| | | |
|---|---|---|
| ES | 2237218 | 7/2005 |
| JP | 2003116676 A | 4/2003 |
| KR | 200418800 Y1 | 6/2006 |

OTHER PUBLICATIONS

PCT ISR from WO2010090753A2 (related to U.S. Appl. No. 12/703,034).

*Primary Examiner* — Robert G Santos
*Assistant Examiner* — David E Sosnowski
(74) *Attorney, Agent, or Firm* — Guy Cumberbatch

(57) ABSTRACT

An easy-access over-the-bed bassinet especially useful in hospitals for new mothers and babies. The bassinet has a barrier to prevent the infant from rolling off a sleeping platform, and one portion or wall of the barrier is convertible to permit a mother to reach in and cradle the infant, for breast-feeding for example. The convertible portion has a restoring mechanism such as a spring force or weighted arm to transform it back to its original barrier position upon removal of the weight of the mother's arms. The convertible portion may be a wall surrounding the sleeping platform that translates vertically into a frame, or pivot about a bottom edge, or pivot underneath the sleeping platform. The entire sleeping platform may tilt about a horizontal axis, and may rotate about a vertical axis for ease of positioning relative to the mother. The bassinets are mounted on sturdy frames that permit over-the-bed positioning of the sleeping platform, which can be raised or lowered to accommodate varying bed heights, and to assist nurses caring for the baby.

20 Claims, 18 Drawing Sheets

U.S. PATENT DOCUMENTS

| | | | | |
|---|---|---|---|---|
| 6,360,384 | B1 * | 3/2002 | Kuempel | 5/414 |
| 6,550,082 | B2 | 4/2003 | Tharalson | |
| 6,862,757 | B2 | 3/2005 | Andriunas | |
| 6,915,536 | B2 | 7/2005 | Chen | |
| 6,934,981 | B2 | 8/2005 | Waldman | |
| 7,013,505 | B2 | 3/2006 | Martin | |
| RE39,136 | E | 6/2006 | Tharalson | |
| 7,406,725 | B2 | 8/2008 | Martin | |
| 7,540,046 | B1 * | 6/2009 | Lai | 5/100 |
| 7,827,631 | B2 * | 11/2010 | Holman | 5/93.1 |
| 8,096,006 | B2 * | 1/2012 | DeBraal et al. | 5/424 |
| 8,216,248 | B2 * | 7/2012 | Brown et al. | 606/119 |
| 2005/0246835 | A1 * | 11/2005 | Tu | 5/93.1 |
| 2007/0056109 | A1 | 3/2007 | Forshpan | |
| 2008/0141457 | A1 | 6/2008 | Forshpan | |
| 2008/0222810 | A1 | 9/2008 | Epshetsky | |

* cited by examiner 104
106
102
100

110
112

116
114
118

110
104
102

134
132
130

136
132
138

α
138

124
126
122
120
128
129

126
128
122
128

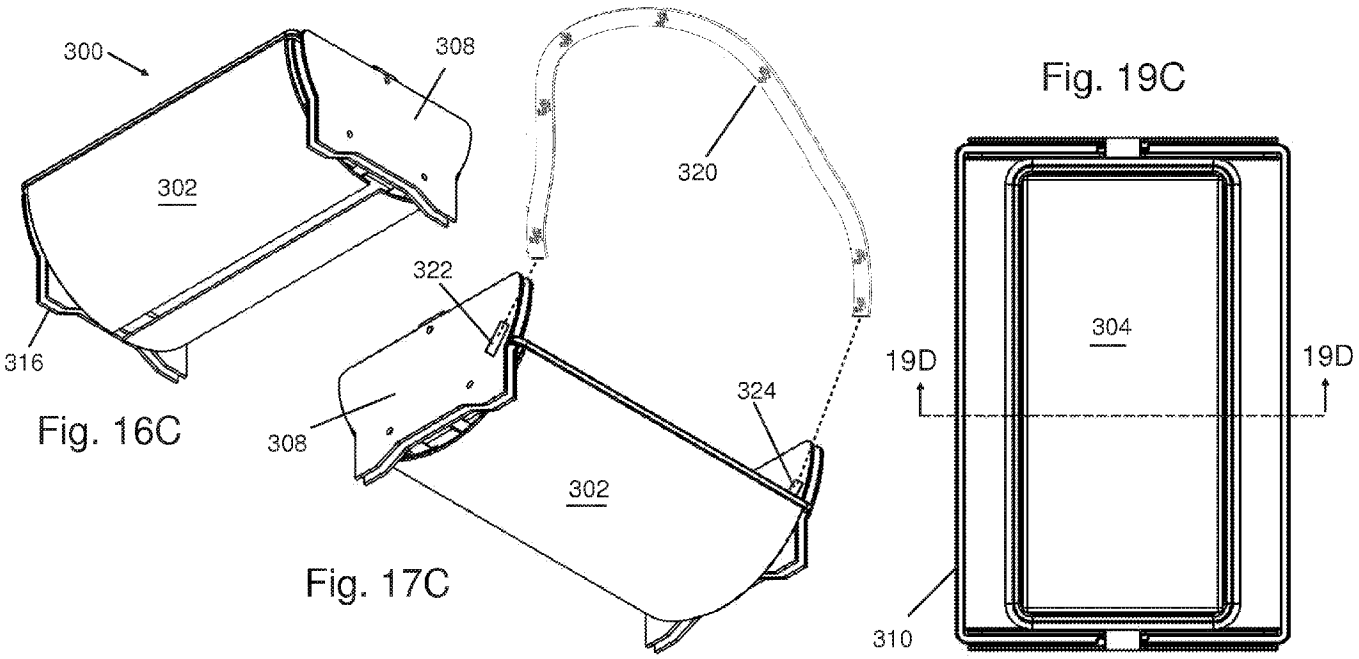
Fig. 16C
Fig. 17C
Fig. 19C
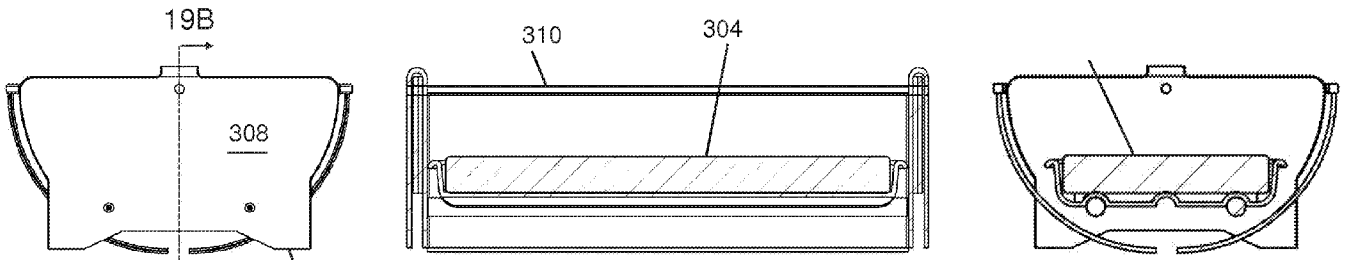
Fig. 19D
Fig. 19B
Fig. 19A

EASY-ACCESS SAFETY BASSINET

RELATED APPLICATIONS

The present application claims priority under 35 U.S.C. §119(e) to U.S. Provisional Application No. 61/207,272, filed Feb. 9, 2009 under the same title.

FIELD OF THE INVENTION

This invention relates generally to bassinets and, more particularly, to an over-the-bed bassinet that enables a mother to easily access an infant therein and provides a safety feature to prevent the infant from falling out.

BACKGROUND OF THE INVENTION

National statistics report over 4 million births in the U.S. in 2007, which is over 300,000 births per month, or 30,000 births per day. The average length of stay for a mother and baby is 3 days; including both vaginal and cesarean deliveries. Every baby requires a bassinet for the postpartum hospital stay, and there are approximately 900,000 bassinets presently in hospitals throughout the United States. The average bassinet that is presently used in the hospital costs approximately $1000, and the most popular model is a standalone crib-type.

Hospitals have embraced the "rooming in concept", that allows the mother to have her newborn in her hospital room day and night. The infant is in the care of the mother, who has just delivered her baby. New mothers naturally want to cuddle the infant, and many of course commence breast-feeding right away. However, the arduous labor process and the possibility of the mother having received narcotics during labor or during her cesarean section results in fatigue and exhaustion. This increases the chance of a mother falling asleep with her infant. It has also been reported that mothers will sacrifice sleeping while attending to their infant, and the research has proven that sleep deprivation can lead to postpartum depression and anxiety. Furthermore, in extreme cases infants die from suffocation as a result of a sleeping mother unknowingly laying on her infant and cutting off the infant's airway.

Consumers are driving the rooming-in concept versus the traditional concept of having the infant in the nursery at night, coming out only for feedings. While research supports the theory that rooming-in facilitates mother-infant bonding and increases successful breast feeding, there is much concern about mothers getting adequate rest, and of course about the possible danger to the infant. Nursery nurses are unable to observe the infants in their charge as closely when they are rooming-in with their mothers, and while nurses round on their patients on a consistent basis, there is always a chance for an accident to occur due to an infant being in bed with a sleeping mother. While there is substantial research surrounding postpartum depression and sleep deprivation, little has been done to explore possible solutions to insure that mothers are able to get adequate sleep during their hospital stay.

In addition, nurses on post partum floors report that the number one reason a mother asks for help is that she is too tired to get her baby out of the nearby bassinet, or too tired to return the baby to the bassinet, and needs the nurse to assist her. It is understandable that an exhausted mother could easily fall asleep before getting up to return her infant to its bassinet. The primary concern is that an exhausted mother who is feeding her baby in bed does not realize she is drifting off to sleep and will fall asleep with the baby in her arms, and the nursing staff will not be aware of the situation.

Statistics have shown that infants have suffocated in hospital settings due to "overlaying" (lying on the baby while sleeping). There are many reports of infants falling from their sleeping mother's arms onto the floor. Studies have also shown that there are over 700 reported infant falls in hospitals in the U.S. annually, and probably many more unreported events. The falls usually occur when a mother falls asleep nursing her baby and the baby falls out of her arms and onto the floor.

Indeed, the U.S. Consumer Product Safety Commission, along with the American Academy of Pediatrics, warns parents not to place their infants to sleep in adult beds. These organizations state that the practice of co-sleeping puts babies at a higher risk of suffocation and strangulation. According to the U.S. Consumer Product Safety Commission the primary risks of infants sleeping in adult beds include suffocation caused by an adult rolling on top of or next to a baby; suffocation when an infant gets trapped or wedged between a mattress and a headboard, nightstand, wall, or other object; suffocation resulting from a baby being face down on a waterbed, a regular mattress or on soft bedding, such as pillow blankets, or quilts; and strangulation in a headboard or footboard that allows a portion of an infant's body to pass through an area while trapping the baby's head.

To avoid these risks, there are ways to keep a baby close by, but not in the adult's bed. A bassinet that allows a mother to view her infant without having to get out of bed, and be able to access her infant while in bed, can help prevent sleeping accidents from occurring, thereby reducing a mother's anxiety and promoting rest and safety for the mother during her postpartum hospital stay. For example, a baby can be placed in a bassinet or crib next to the adult's bed. There are also devices that look like a bassinet minus one side, which attaches to the adult bed and is termed a "co-sleeper." These devices allow the parent and baby to be next to one another without the possibility of the parent rolling over onto the infant. Various co-sleepers that attach to a bedside are disclosed in U.S. Pat. Nos. 5,172,435, 5,430,899, 6,934,981, and 7,406,725.

Unfortunately, many rooms do not have enough space to place these devices in the same room as the adult bed, let alone at the side of the adult bed. When used, a bassinet placed next to a bed will be inconvenient in that only one adult on one side of the bed will have convenient access to it. Additionally, when a bassinet is placed near the side of the bed, this can block easy access to the bed and make it difficult for an adult to move in or out of the bed. In a hospital setting the co-sleeper may interfere with the nurses' duties.

Another design where the infant bed is suspended above the adult bed is seen in U.S. Patent Publication No. 2008/0222810. This device features a holding structure supported by a horizontal arm extending from a relatively sturdy support stand behind the head of the bed, or by a "C-shaped" apparatus which extends from below the bed upward, and over the adult bed area. The constructions shown are relatively bulky and likely expensive, and the overall ergonomic functioning leaves something to be desired.

In an effort to improve outcomes for mothers and infants, an over-the-bed bassinet designed for a mother's comfort and the baby's safety, and which is relatively simple and cost-effective, is needed.

SUMMARY OF THE INVENTION

The present application provides an easy-access over-the-bed bassinet especially useful in hospitals for new mothers and babies. In one embodiment, the bassinet, comprises a frame on which is mounted a sleeping platform surrounded by an upstanding enclosure including walls that present a protective barrier to an infant rolling off of the sleeping platform. At least one of the walls converts between an elevated position and a lowered position in which the barrier on that side is lowered. The front wall mounts in the bassinet with a restoring mechanism that causes the front wall to automatically return toward the elevated position from the lowered position in the absence of a barrier to upward movement.

The front wall may remain oriented substantially vertically and translate up and down when converting between the elevated and lowered positions, or may pivot outward about a bottom edge when converting between the elevated and lowered positions. In one embodiment, the front wall pivots downward under the sleeping platform when converting between the elevated and lowered positions. Desirably, the front wall has an arcuate shape that curves under the sleeping platform and attaches to a weighted frame to bias the front wall upward.

The restoring mechanism may comprise a spring mechanism that biases the convertible wall toward the elevated position from the lowered position, or may be a weighted centering arm attached to displace the front wall upward from its lowered position. For example, the restoring mechanism may comprise at least one leaf spring positioned below a bottom edge that compresses when the front wall descends to its lowered position. The bassinet may have locking structure for securing the front wall in its elevated position, the locking structure being adapted for manual release.

In accordance with one aspect, the bassinet includes a strap having fasteners at either end for attaching to mating fasteners on the bassinet on either side of the front wall. At least one of the fasteners on the bassinet causes the strap to pass over the front wall and present a barrier to upward movement from the lowered position thereof. Both the front and rear walls may be convertible between an elevated position presenting a barrier to an infant rolling off the sleeping platform on those respective sides and a lowered position in which the barrier is substantially removed. Both the sleeping platform and the upstanding enclosure may be rotatably mounted about a vertical axis with respect to the frame. In one embodiment, the sleeping platform and upstanding enclosure are mounted to pivot about a horizontal axis with respect to a support stand to permit limited tilting.

Another aspect of the invention is a bassinet that provides ergonomic support for a mother while she is breast feeding her baby, comprising a stand including a base, an elevated frame, and an upstanding support member connecting the elevated frame above the base, the upstanding support member being connected to the elevated frame in such a manner that the elevated frame may be positioned over a bed. A sleeping platform is supported by the elevated frame, and an upstanding enclosure surrounding the sleeping platform includes walls that present a protective barrier to an infant rolling off of the sleeping platform. At least one of the walls is convertible between an elevated position and a lowered position in which the barrier on that side is lowered. The convertible wall mounts in the bassinet with a restoring mechanism that causes the convertible wall to return toward the elevated position from the lowered position in the absence of a barrier to upward movement. The bassinet is able to support the mother's arms while resting on the convertible wall in the lowered position and nursing her baby on the sleeping platform, and the convertible wall will tend to return toward the elevated position when the mother's arms are no longer resting on the side wall.

The bassinet further may include a sliding shelf that retracts under the sleeping platform. The front wall may remain oriented substantially vertically and translate up and down when converting between the elevated and lowered positions, or may pivot outward about a bottom edge when converting between the elevated and lowered positions. In one embodiment, the front wall pivots downward under the sleeping platform when converting between the elevated and lowered positions. Desirably, the front wall has an arcuate shape that curves under the sleeping platform and attaches to a weighted frame to bias the front wall upward.

The restoring mechanism may comprise a spring mechanism that biases the convertible wall toward the elevated position from the lowered position. In one embodiment, the restoring mechanism comprises a weighted centering arm attached to displace the front wall upward from its lowered position. The bassinet may also include a strap having fasteners at either end for attaching to mating fasteners on the bassinet on either side of the front wall, wherein at least one of the fasteners on the bassinet causes the strap to pass over the front wall and present a barrier to upward rotation from the lowered position thereof.

In accordance with a further aspect of the invention, a bassinet that provides ergonomic support for a mother while she is breast feeding her baby comprises a stand including a base, an elevated frame, and an upstanding support member connecting the elevated frame above the base. The upstanding support member connects to the elevated frame in such a manner that the elevated frame may be cantilevered over a bed. A sleeping platform is supported by the elevated frame, and an upstanding enclosure surrounds the sleeping platform and includes walls that present a protective barrier to an infant rolling off of the sleeping platform. The enclosure walls including opposite end walls and front and rear walls, wherein at least the front wall converts between an elevated position and a lowered position in which the barrier on that side is lowered. Further, the front wall pivots downward under the sleeping platform when converting between the elevated and lowered positions. The bassinet is able to support the mother's arms while resting on the front wall in the lowered position and nursing her baby on the sleeping platform.

In a preferred embodiment, the front wall mounts in the bassinet with a restoring mechanism that causes the front wall to return toward the elevated position from the lowered position in the absence of a barrier to upward movement, and the front wall will tend to return toward the elevated position when the mother's arms are no longer resting on the front wall. The front wall may have an arcuate shape that curves under the sleeping platform and attaches to a frame weighted to bias the front wall upward. Both the front wall and the rear wall may be convertible between an elevated position and a lowered position in which the barrier on that side is lowered, and both may pivot downward under the sleeping platform when converting between the elevated and lowered positions. The bassinet desirably includes a strap having fasteners at either end for attaching to mating fasteners on the bassinet on either side of the front wall. At least one of the fasteners on the bassinet causes the strap to pass over the front wall and present a barrier to upward rotation from the lowered position thereof.

BRIEF DESCRIPTION OF THE DRAWINGS

Features and advantages of the present invention will become appreciated as the same become better understood with reference to the specification, claims, and appended drawings wherein:

FIGS. 16A-16C are perspective views of a still further bassinet having a convertible wall mounted on a frame that pivots about a central longitudinal axis of the bassinet, the wall being shaped and arranged to roll underneath a sleeping platform;

FIGS. 17A-17C are perspective views of the bassinet in FIGS. 16A-16C with one convertible wall shown underneath a sleeping platform;

FIGS. 19A-19D are orthogonal and sectional views of the bassinet in FIGS. 16A-16C;

DETAILED DESCRIPTION OF THE PREFERRED EMBODIMENTS

Figure 1:
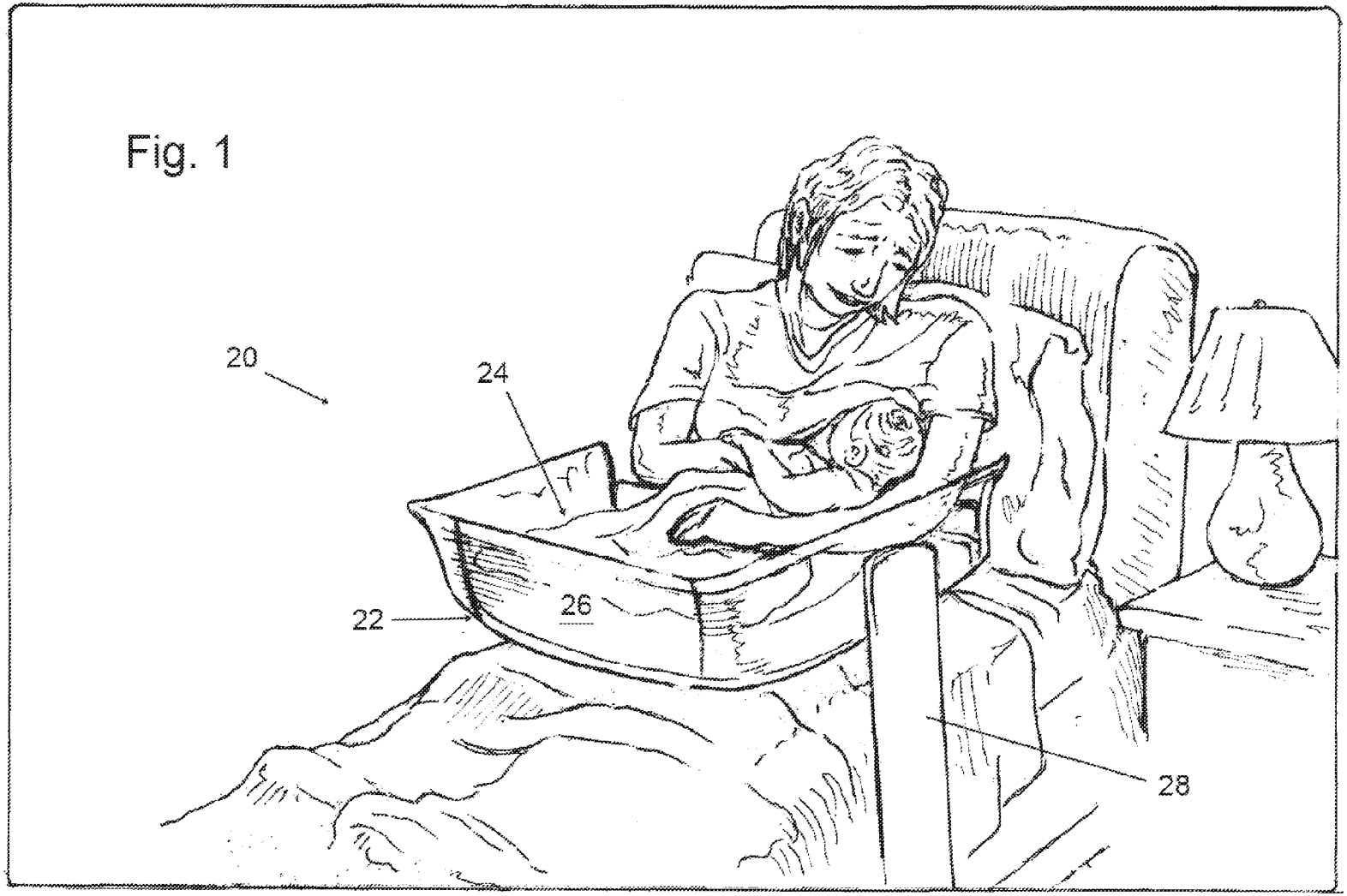
FIG. 1 is a rendering of a mother on a bed nursing a baby who is positioned within a bassinet described herein having a convertible front wall that permits the mother to easily reach in and access the baby.

FIG. 1 illustrates an exemplary over-the-bed bassinet 20 that can be used to provide ergonomic support for a mother while she is breast feeding her baby. The bassinet 20 is desirably able to support up to 500 pounds, to withstand the weight of someone leaning heavily on it and provide a generous margin of safety. The mother is shown holding her newborn and using the bassinet to support her arms while nursing the baby. In the event the mother falls asleep while nursing, and the mother's arms that are holding the newborn relax, the newborn will remain on a sleeping platform of the bassinet, and a protective barrier will automatically be restored to prevent the baby from rolling out of the bassinet.

The bassinet 20 includes a frame 22 on which is mounted a sleeping platform 24 surrounded by an upstanding enclosure 26. Several different types of enclosures are described herein, and others are contemplated. The various enclosures present a barrier to an infant rolling off the sleeping platform 24, and typically include vertical walls surrounding the sleeping platform 24. As will be explained in more detail below, a front portion or wall of the enclosure 26 facing the mother converts from an elevated position presenting a barrier to contain the infant in the bassinet 20, to a lowered position in which the barrier on that side is substantially removed to enable the mother easy access. Moreover, the convertible portion of the enclosure 26 features an automatic return mechanism that ensures the barrier will reform in the absence of any force applied by the mother or other barrier.

In certain embodiments the frame 22, sleeping platform 24 and enclosure 26 are constructed of a single member, while in other versions the frame may be formed of struts or other structural members that supports a separate sleeping platform 24 with an integral or separate enclosure. Also, the frame 22 may comprise a table on which the bassinets described herein are supported, or may be structural members that support or suspend the bassinets, the term "frame" being used to signify the cantilevered structure that permits the bassinet to extend over a bed. Those of skill in the art will understand that there are numerous ways for supporting an enclosed sleeping platform over a bed, and that the claims should not be limited by any particular embodiment disclosed herein.

As seen in FIG. 1, the bassinet 20 further includes a stand having an upstanding support member 28 above a stabilizing base (not shown) that may be mounted on wheels for portability. As typical with hospital equipment, the wheels are lockable. The support member 28 elevates the frame 22 in such a manner that the sleeping platform 24 extends horizontally over the bed. The overall profile of the bassinet 20 resembles the letter "C" with the base typically sized to slide under the bed while the sleeping platform 24 over the bed, much like conventional food service carts, though much more sturdy.

It should be noted that although most of the bassinets described herein are shown as "over-the-bed" types, which extend over a bed such as a hospital bed for convenience, many features of the bassinet are useful for traditional designs. For example, the convertible walls described herein may be useful for bassinets that stand by themselves on a vertical frame, not designed to go over the bed. Likewise, accessories such as sliding shelves and drawers in combination with the convertible bassinet are not just useful for over-the-bed designs.

Figure 2:
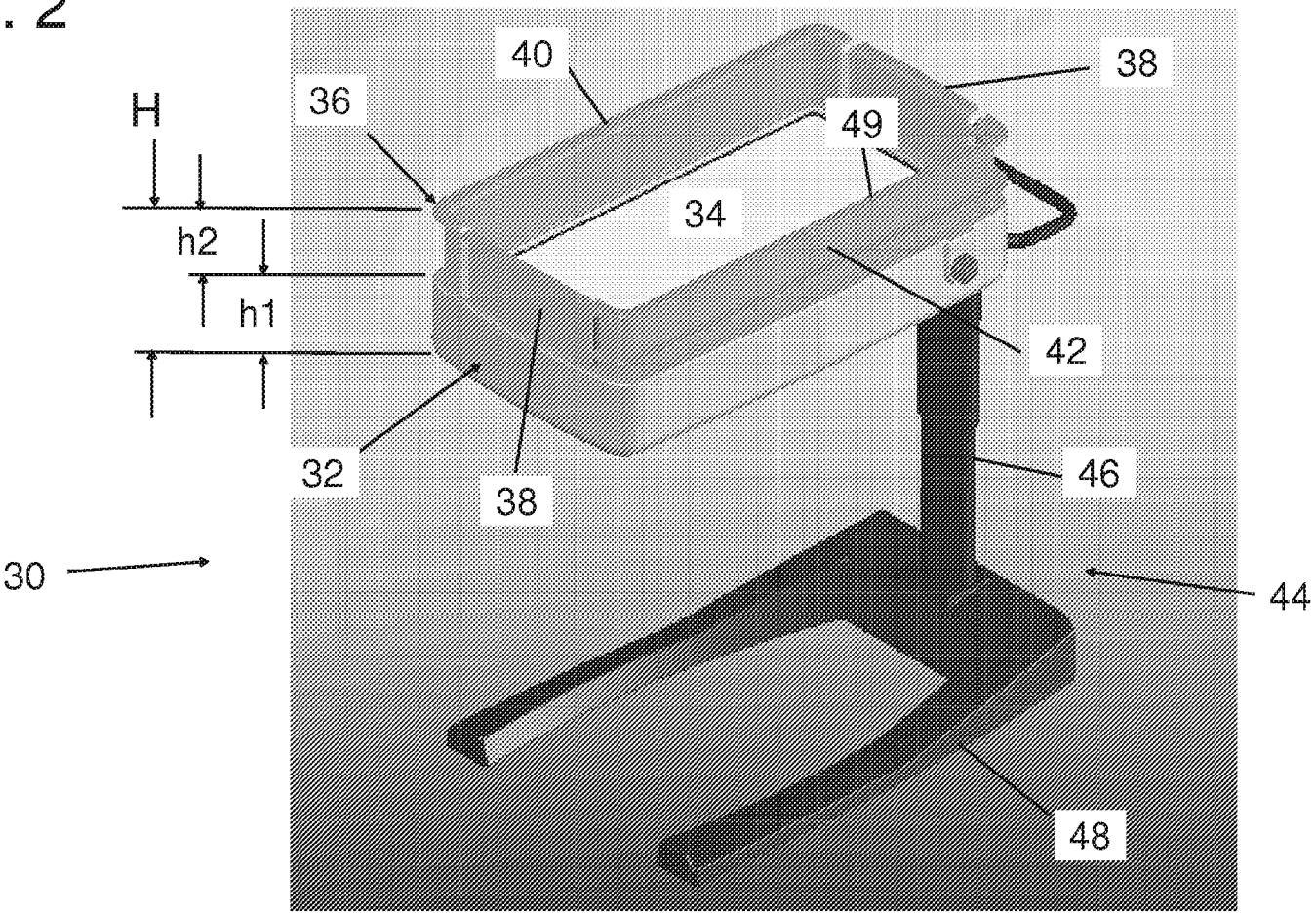
FIG. 2 is a perspective view of an exemplary over-the-bed easy-access bassinet of the present application.

FIG. 2 shows one exemplary bassinet 30 having a frame 32 on which is mounted a sleeping platform 34 surrounded by an upstanding enclosure 36. The enclosure 36 comprises end walls 38, a rear wall 40, and a front wall 42. In the illustrated embodiment the enclosure 36 defines a rounded rectangular shape with parallel end walls 38 being shorter than the parallel rear wall 40 and front wall 42. As will be described below, the front wall 42 converts between an elevated position presenting a barrier to an infant rolling off the sleeping platform 34 on that side and a lowered position in which the barrier is substantially removed. Although only the front wall 42 is shown as convertible, other walls or portions of the enclosure 36 may be convertible to increase the number of approaches for reaching in to the bassinet.

The frame 32 mounts on an upper end of a stand 44 having a support member 46 extending upward from a stabilizing base 48. The support member 46 may include structure to enable height adjustment, such as telescoped beams. Indeed, a power-assisted height adjust mechanism, such as in hospital beds, may be included. The bassinet 30 can thus be raised or lowered to accommodate varying bed heights, and to assist nurses caring for the baby, such as allowing the nurse to lift the baby without having to bend over too far.

As mentioned, the bassinet 30 desirably describes a C-shape with the base 48 able to fit under a bed, while the frame 32 and sleeping platform 34 extend over the bed. In this regard, the base 48 can be raised and lowered to accommodate different bed heights. It should be noted, however, that certain features of the convertible enclosure may be suitable for other configurations of over-the-bed bassinets, and even for bassinets that are not designed to go over a bed.

One particularly convenient manner in which to enable the front wall 42 to convert between its elevated and lowered positions is to mount it for vertical displacement relative to the frame 32. That is, the front wall 42 maintains a generally vertical orientation and slides downward relative to the frame 32 and to the adjacent end walls 38. In one embodiment, the front wall 42 slides downward into the frame 32 to conceal its moving parts. For instance, the total height H of the frame 32 and enclosure 36 may be approximately twice the heights h1, h2 of the frame and enclosure, respectively. A space or cavity within the frame 32 receives and conceals the front wall 42 as it descends (not shown). Various structures to enable this particular sliding mechanism are described below.

In use, a mother lying on a bed may reach over the enclosure to cradle the baby, at the same time resting her arms on the front wall 42 which descends into the frame 32. The lowered position of the front wall 42 coincides with an upper edge 49 thereof being approximately at the level of the sleeping platform 34, or a mattress placed thereon. This removes the peripheral barrier from around the sleeping platform 34 and the mother's arms can rest comfortably over the lowered front wall 42 which is preferably rounded to eliminate sharp corners. The baby remains on the sleeping platform 34. This configuration is particularly comfortable for an extended period of breast-feeding, for example.

The front wall 42 is also desirably mounted in the bassinet 30 with a restoring mechanism that causes it to automatically return toward the elevated position from the lowered position in the absence of an external force or barrier, such as the mother's arms draped over the wall. When the mother desires to place the sleeping baby back into the enclosure 36, or if she happens to doze off while breast-feeding, the baby remains on the sleeping platform 34 and removal or relaxation of the mother's arms removes a downward force on the front wall 42, which permits it to return toward its elevated position. The weight of the mother's arms provides a downward force greater than the restoring force of the front wall 42, and thus the restoring force may be calibrated to be just slightly less than a minimum arm weight, perhaps 3-5 pounds (6.6-11.0 kg). A preferred means of restoring the front wall 42 to its elevated position and reforming the enclosure is to provide one or more springs biasing the front wall 42 upward. The springs are easily overcome by the weight of the mother's arms, yet strong enough to raise the front wall 42 against lesser weights or in the absence of a downward force or other barrier.

Figures 3A, 3B, 3C:
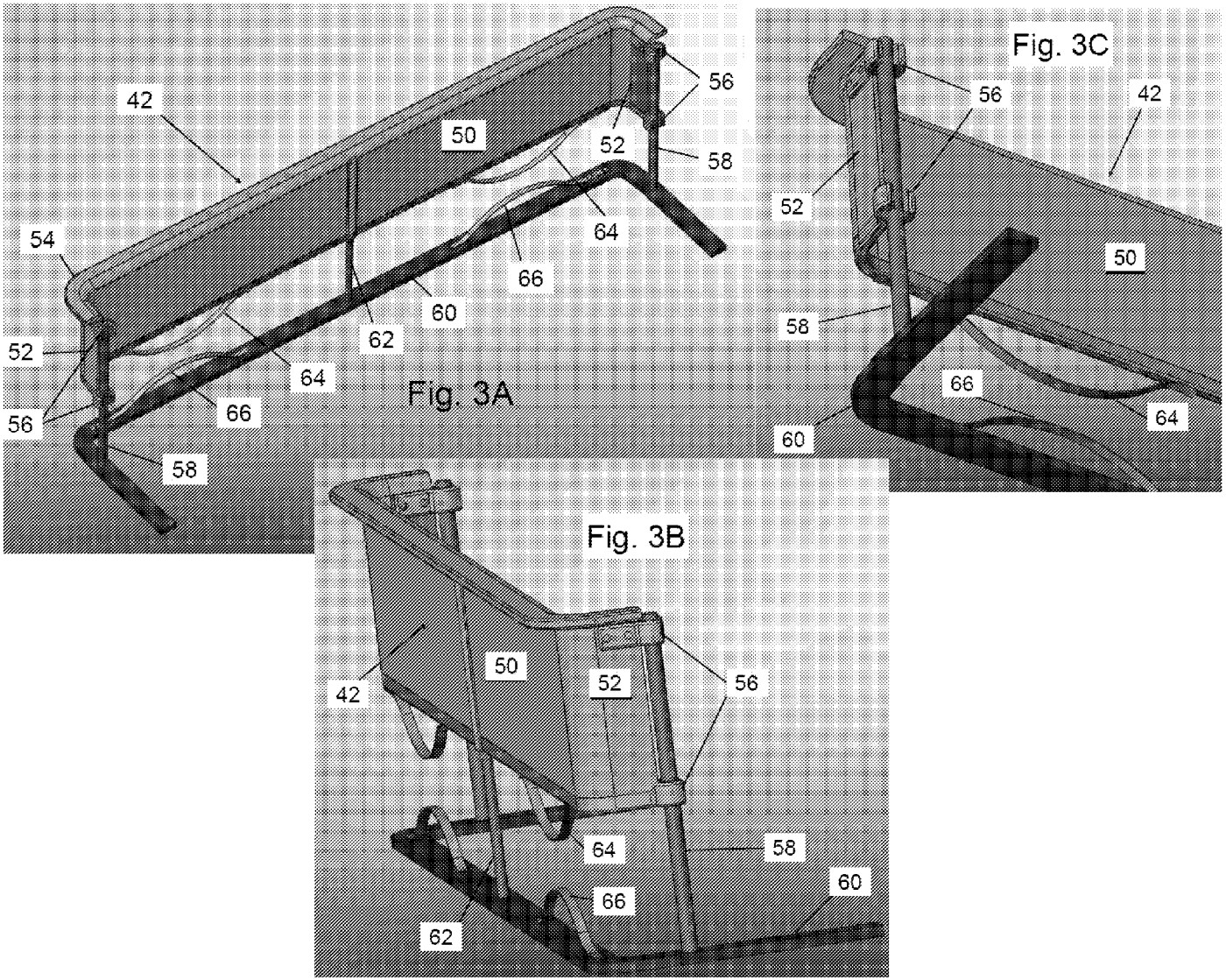
FIGS. 3A-3C are several perspective views of an exemplary convertible front wall for use with the easy-access bassinets of the present application.
Figure 4A:
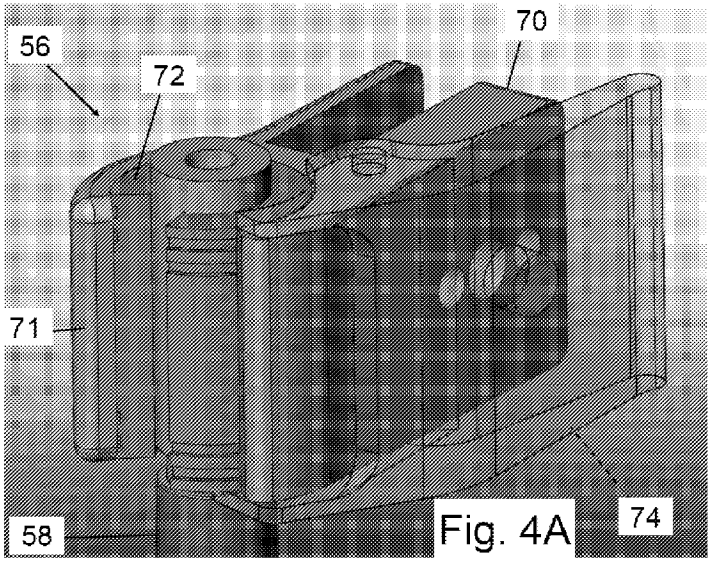
FIG. 4A-4D are perspective views of a locking clip for use in the convertible front wall locking mechanism described herein.
Figure 3D:
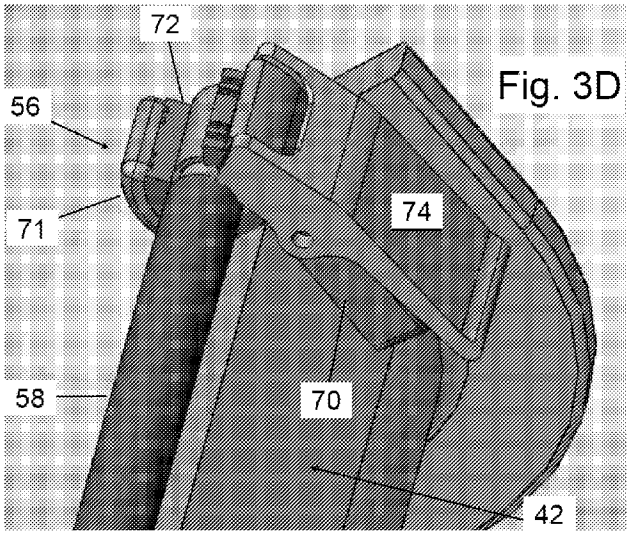
FIGS. 3D and 3E are perspective views of an exemplary locking mechanism for the convertible front wall of FIGS. 3A-3C.
Figure 3E:
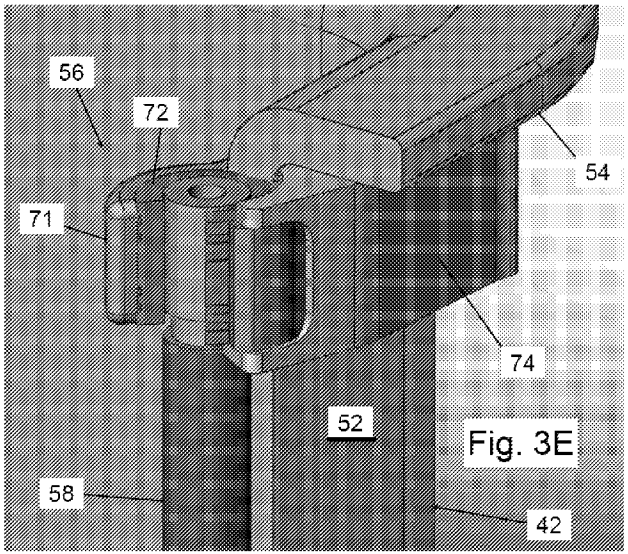
Figure 4C:
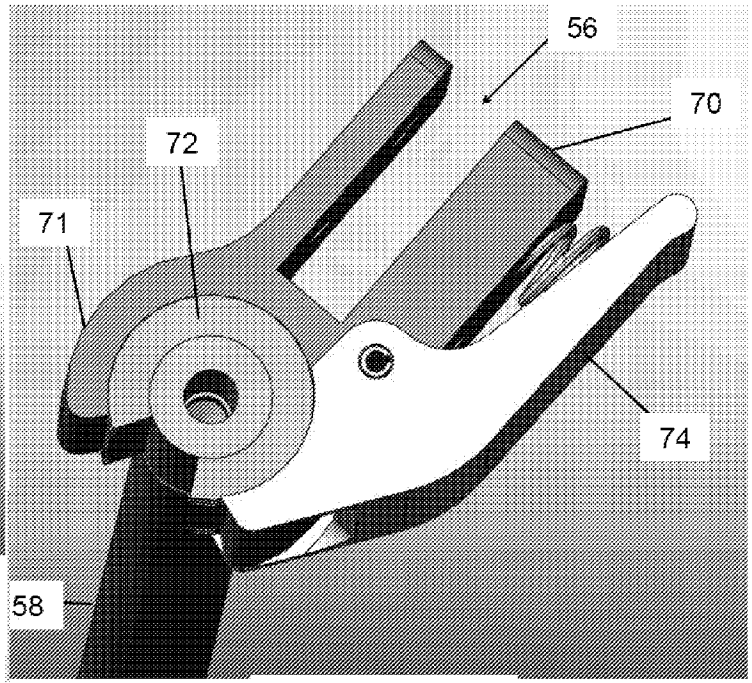
Figure 4B:
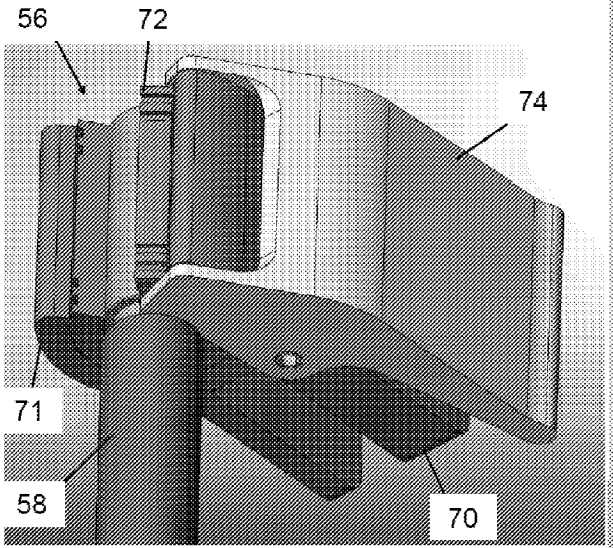
Figure 4D:
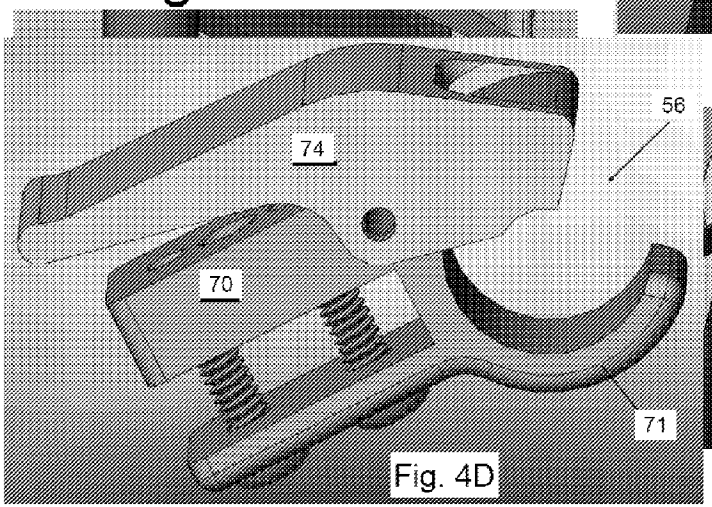

FIGS. 3A-3C are several perspective views of an exemplary convertible front wall 42 for use with the bassinet 30 of FIG. 2. The front wall 42 includes a vertical main panel 50 and two end panels 52 that are generally perpendicular thereto. All of the top edges of the panels 50, 52 feature rounded lips 54 curving horizontally outward for both the mother's and baby's comfort. The three panels 50, 52 may be separate and attached together, but are preferably a single element molded from a polymer suitable for use in a hospital.

Two sliding clamps 56 mount along vertical edges of each end panel 52 and slide vertically on rods 58. The rods 58 extend upward from a frame piece 60, which represents a portion of the frame 32 shown in FIG. 2, for example. A smaller central rod 62 may also be provided on the frame piece 60 for sliding cooperation with a vertical channel (not seen) formed in the middle of the main panel 50. Various other ways to enable vertical movement of the front wall 42 relative to the frame 32 are also contemplated.

Spaced pairs of opposed leaf springs 64, 66 are positioned on the front wall 42 and frame 32. In the illustrated embodiment, one end each of two convex-downward leaf springs 64 mount to the bottom edge of the main panel 50, and one end each of two convex-upward leaf springs 66 mount to the frame piece 60 at the same locations. Descent of the front wall 42 brings these mating pairs of leaf springs together and provides a smooth restoring force biasing the front wall upward. The free end of each leaf spring 64, 66 slides along the adjacent wall or frame surface. Preferably, the apices of the leaf springs 64, 66 come into contact when the front wall 42 is in its elevated position such that downward movement toward the lowered position creates a gradually larger biasing force. Those of skill in the art will understand that coil or tension springs may be used, as well as hydraulic or pneumatic piston/cylinder arrangements, and the location and integration of the springs with the frame 32 and front wall 42 may also be varied.

Details of the interaction between the sliding clamps 56 and rods 58 are seen in FIGS. 3D and 3E, and FIGS. 4A-4D further illustrate possible constructions therefore. The sliding clamps 56 provide an easy-to-operate temporary locking structure for securing the front wall 42 in its elevated position. Various ways to secure the front wall 42 or other configuration of convertible wall in an elevated position can be used, and the illustrated embodiment should not be considered limiting. The exemplary sliding clamps 56 comprise spring-biased clips, one on each lateral side of the front wall 42 such that two hands are required to release the front wall from its secured position. Each clamp 56 has a body 70 attached to the wall 42 with a partial tubular portion 71 that engages the rod 58, and may further include an elastomeric sleeve 72 for additional friction with the rod. A spring biased lever 74 applies a clamping force against the rod 58 until the mother squeezes it to release the clamp and permit lowering of the front wall 42. The sleeve 72 provides some damping so that the wall 42 steadily slides down when the mother leans on it. The sleeve 72 provides enough friction so that the wall 42 doesn't fall down when it is unlocked and without the mother leaning on it. Note that the springs and clamps could be replaced with a spring-shock absorber mechanism (such as described below with reference to FIG. 14). Note in FIG. 3E how the rounded lips 54 at the top edges of the end panels 52 partly conceal the clamps 56 when in the elevated position.

Figure 6:
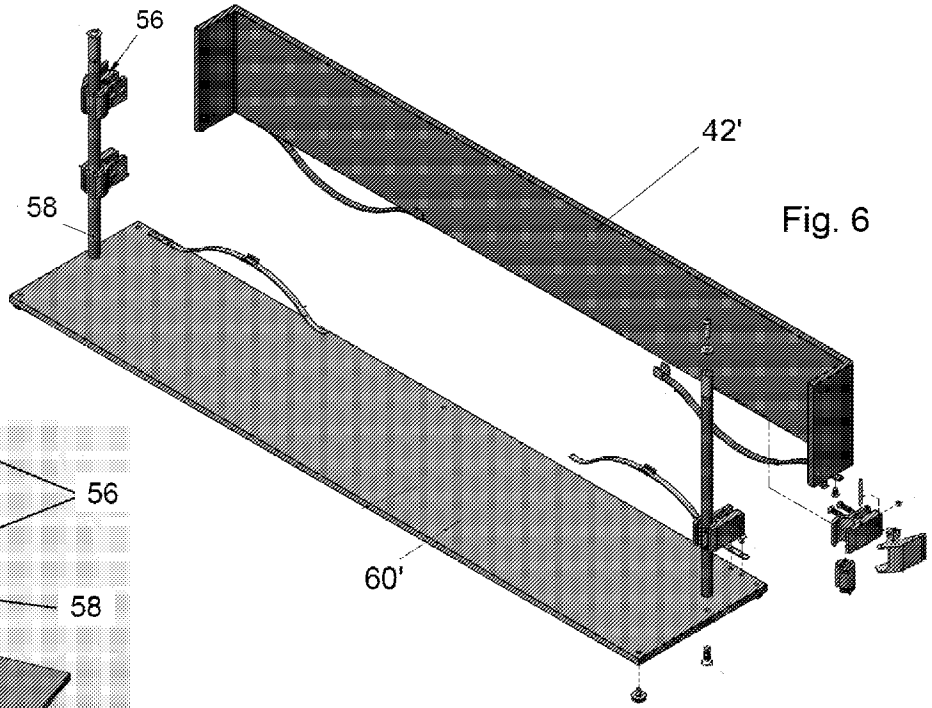
FIG. 6 is an exploded perspective views of a convertible front wall, an exemplary restoring mechanism, and locking structure using locking clips.
Figure 5:
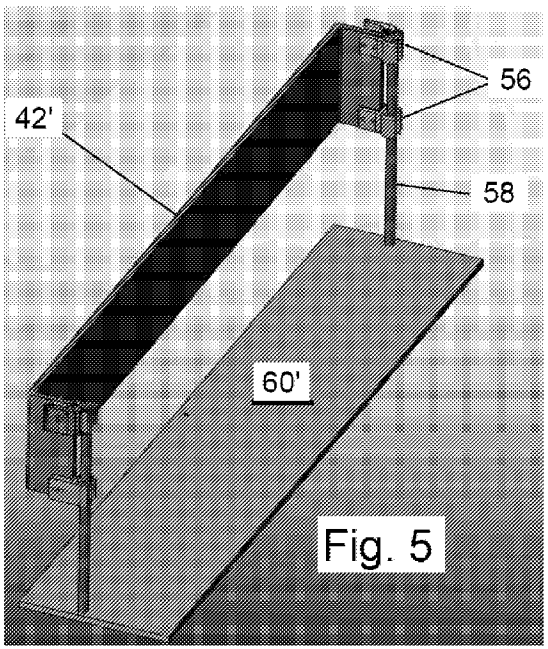
FIG. 5 is a simplified perspective view of an alternative vertically movable convertible front wall for the bassinet described herein.

FIGS. 5 and 6A-6B illustrate a simplified front wall 42' that is similar in many respects to the earlier described front wall 42 mounted for vertical movement relative to a frame piece 60', and which, again, represents a portion of the frame 32 shown in FIG. 2. Like elements will be given like numbering. The simplified front wall 42' is shown as planar panels, without the ergonomic curved lips on the top edges. Constructional details are shown in the exploded views of FIGS. 6A-6B which will not be further described.

Figure 7A:
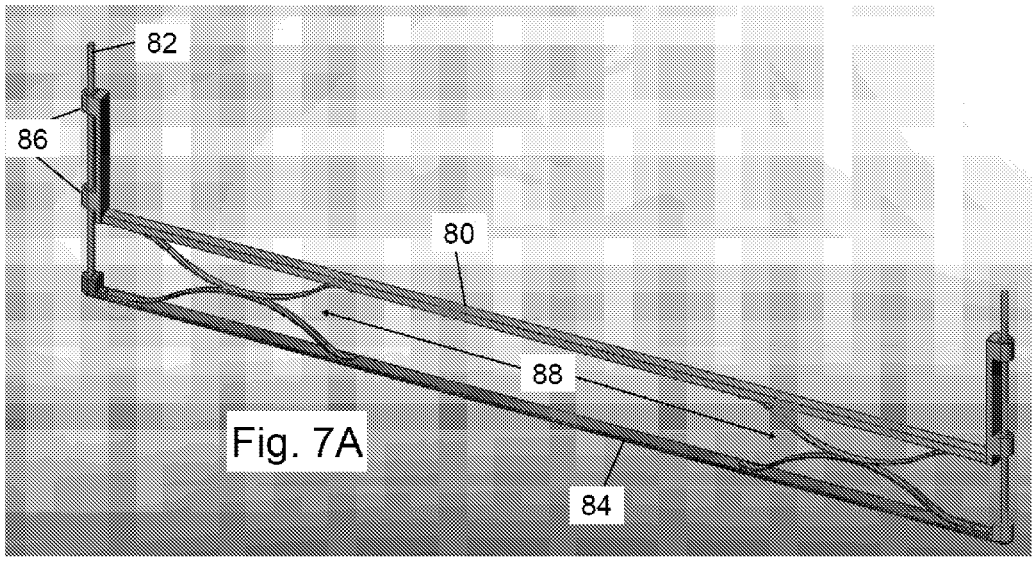
FIGS. 7A-7C are perspective views of the frame of a convertible front wall arranged to slide vertically and having a leaf spring restoring mechanism.
Figure 7B:
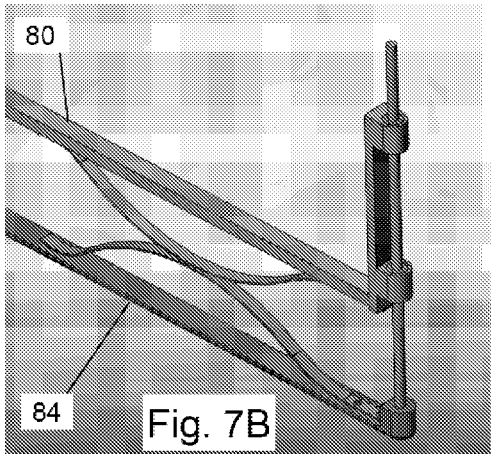
Figure 7C:
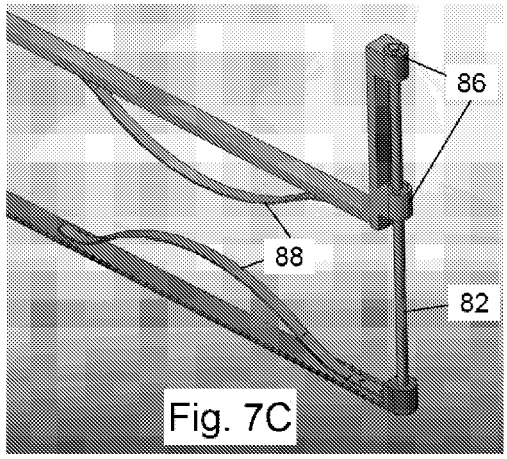

FIGS. 7A-7C show another simplified arrangement for a convertible wall or panel for the bassinets of the present application. In these views, a wall bracket 80 is shown mounted for vertical movement along a pair of rods 82 that project upward from a frame piece 84. The wall bracket 80 includes a pair of slides 86 that receive the rods 82. A pair of opposed leaf springs 88 again provide a restoring force to downward movement of the wall bracket 80 relative to the frame piece 84. Any number of panels or other such barriers may be mounted to the wall bracket 80 to complete the bassinet enclosure.

FIGS. 8A-8E illustrate an alternative oval-shaped bassinet 100 that includes a frame 102 on which is mounted a sleeping platform 104 surrounded by an upstanding enclosure 106. The enclosure 106 comprises a rear wall 110 and a front wall 112. In the illustrated embodiment the enclosure 106 defines an oval shape wherein both the rear wall 110 and front wall 112 are both arcuate and circumscribe approximately one-half of the perimeter of the enclosure 106. The large size of the convertible front wall 112 and its wrap-around nature provides a large opening for a mother to reach in to the sleeping platform 104 from various angles to cradle the infant.

The frame 102 mounts on an upper end of a stand 114 having a support member 116 extending upward from a stabilizing base 118. The support member 116 may include structure to enable height adjustment, such as telescoped beams. As mentioned, the bassinet 100 desirably describes a C-shape with the base 118 able to fit under a bed while the frame 102 and sleeping platform 104 extend over the bed. In this embodiment, the base 118 includes wheels to facilitate movement of the bassinet 100.

Figures 8A, 8B, 8C, 8D, 8E:
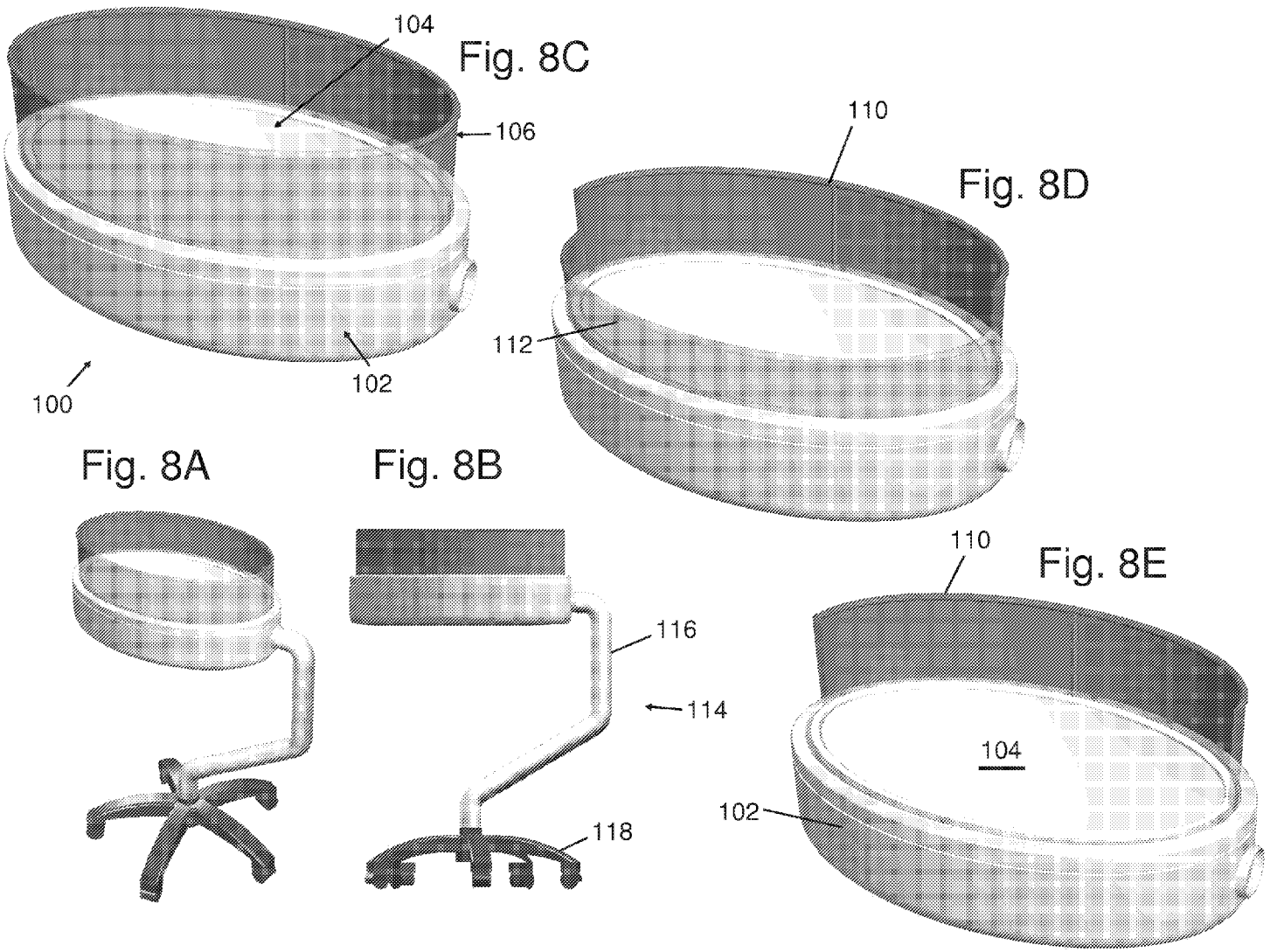
FIGS. 8A-8E are various perspective views of an alternative bassinet of the present application having an oval-shape and a convertible front wall.

FIGS. 8C-8E show a progression wherein the front wall 112 converts between an elevated position as part of a bassinet enclosure presenting a barrier to an infant rolling off the sleeping platform 104 on that side, and a lowered position in which the barrier is substantially removed. The front wall 112 desirably descends vertically and disappears into the frame 102. As with the earlier embodiments, a restoring mechanism such as springs (not shown) within the frame 102 may be provided to facilitate upward movement of the front wall 112 upon removal of a downward pressure such as the mother's arms. Furthermore, although not shown, a locking structure may be provided to secure the front wall 112 in its elevated position while permitting easy release.

Figures 9A, 9B, 10A, 10B, 10C:
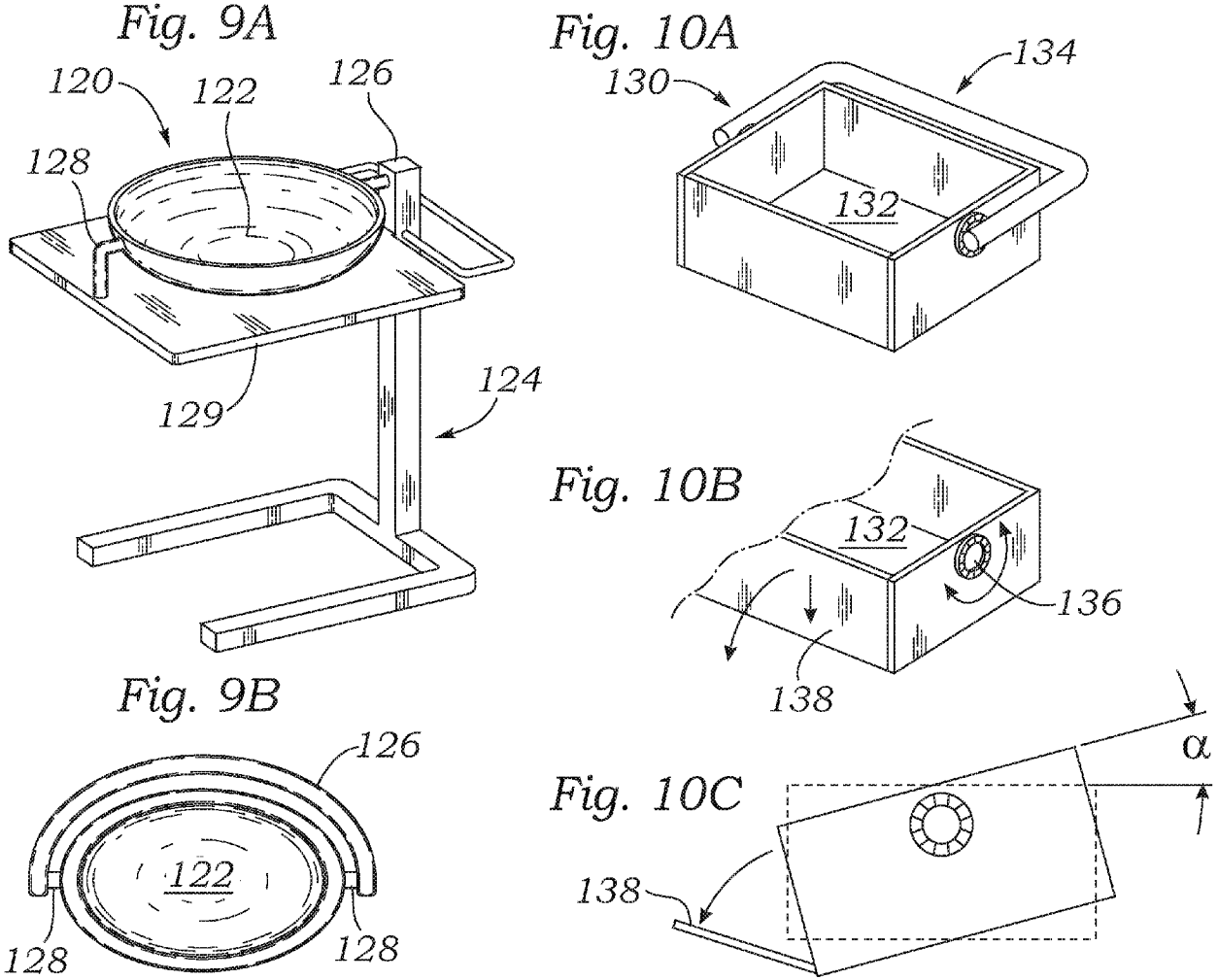
FIGS. 9A-9B illustrate an oval-shaped bassinet arranged to tilt about a horizontal axis relative to a support frame to enable easy access to the interior.
FIGS. 10A-10C illustrate an alternative bassinet arranged to tilt about a horizontal axis relative to a support frame to enable easy access to the interior.

FIGS. 9A and 9B illustrate an alternative oval-shaped bassinet 120 that tilts. The bassinet 120 may have the same configuration as the bassinet 100 described above, but with a sleeping platform 122 (and frame as described) that mounts on a stand 124 having a bracket 126 that provides horizontal pivots 128. In the illustrated embodiment, the pivots 128 engage the oval-shaped sleeping platform 122 at opposite longitudinal ends, though other possible arrangements are contemplated. A table 129 is provided for safety and convenience. The sleeping platform 122 is thus capable of tilting about the pivots 128 to help the mother reach in and cradle the infant. Preferably, the extent of tilting is limited to 10° or less in one direction, more preferably 5° or less. Furthermore, the pivots 128 desirably incorporate a return mechanism, such as watch-type spiral springs, that biases the sleeping platform 122 to its neutral, horizontal orientation. Furthermore, a locking structure having a button or latch release (not shown) on one or both pivots 128 may be added to ensure that the sleeping platform 122 remains in its neutral position until desired.

It should be noted that FIGS. 9A and 9B show two different versions of essentially the same bassinet configuration. In FIG. 9A the pivots 128 mount to opposite sides of the table 129, while in FIG. 9B the bracket extends around one side of the sleeping platform 122 and provides cantilevered support for both end pivots 128.

FIGS. 10A-10C show another tilting bassinet 130 with a more conventional rectangular sleeping platform 132 (and frame as described) that mounts on a stand having a U-shaped horizontal bracket 134 that provides horizontal pivots 136. In the illustrated embodiment, the pivots 136 engage the sleeping platform 132 within a central vertical plane at opposite longitudinal ends, though other possible arrangements are contemplated. The sleeping platform 132 is thus capable of tilting about the pivots 136 to help the mother reach in and cradle the infant. Again, the extent of tilting is desirably limited to 10° or less, more preferably 5° or less. Further, the pivots 136 may incorporate a return mechanism that biases the sleeping platform 132 to its neutral, horizontal orientation, and a locking structure to ensure that the sleeping platform 132 remains in its neutral position until desired.

In addition, FIGS. 10B and 10C show a convertible wall 138 that is desirably used in conjunction with the tilting mechanism. The wall 138 may slide vertically, or pivot outward about a bottom edge, as seen by movement arrows in both figures. The mother can thus release a locking structure and depress the wall 138 to easily convert it from an elevated to a lowered position. At the same time, the entire sleeping platform 132 (and frame) tilts toward the mother to make it easier to reach in and cradle the infant. The convertible wall 138 desirably returns to its upright position when no barrier to such movement is present.

Figure 11C:
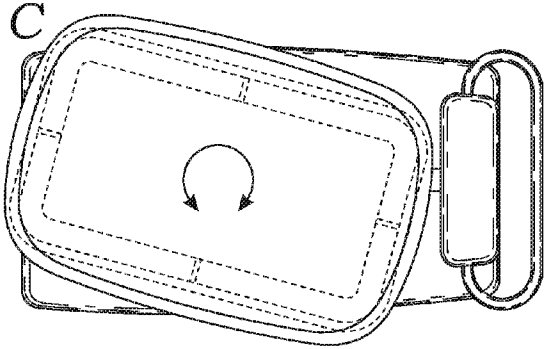
FIGS. 11A-11C illustrate an over-the-bed bassinet with a sleeping platform arranged to rotate about a vertical axis relative to a support frame.
Figure 11B:
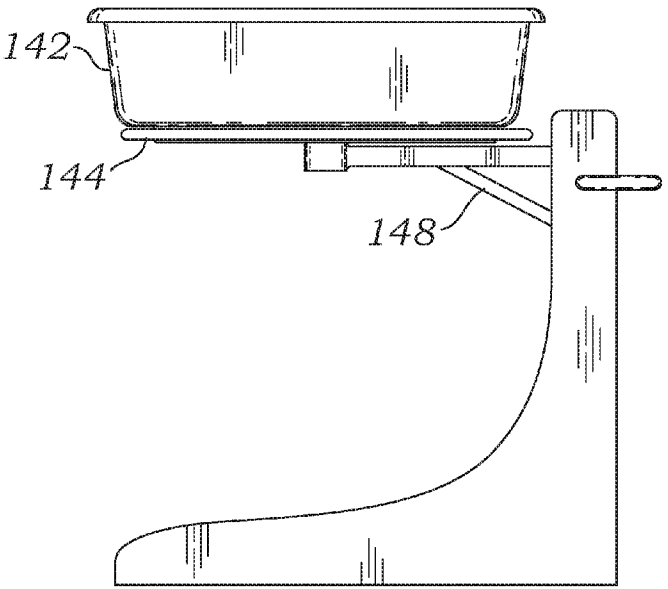
Figure 11A:
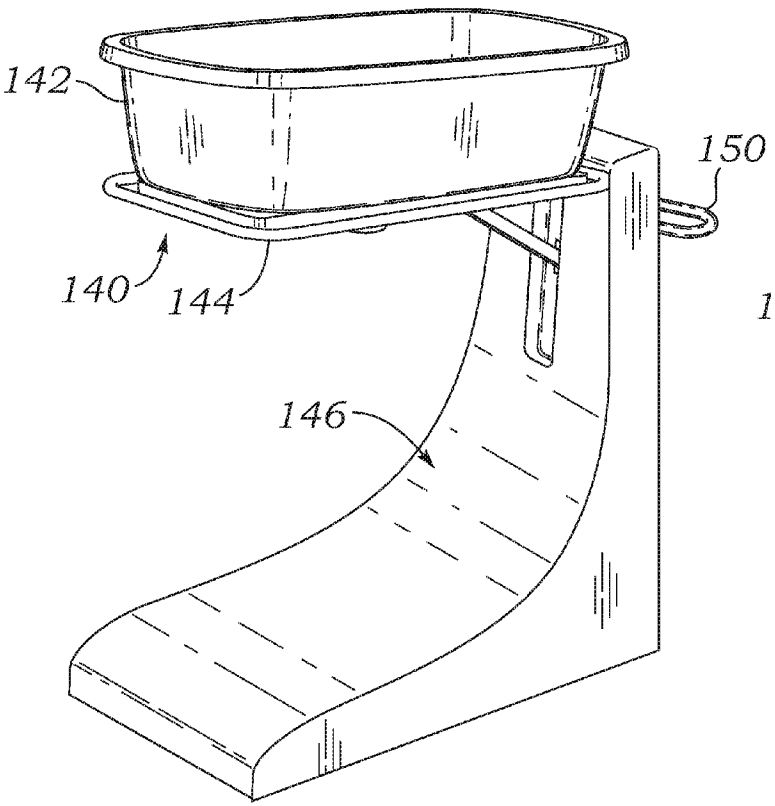

FIGS. 11A-11C illustrate several add-ons that can be combined with any of the aforementioned bassinets. Specifically, a bassinet 140 includes a sleeping platform 142 supported by a frame 144 elevated on a stand 146. The sleeping platform 142 may be any of the configurations described above, and thus may have a convertible wall, oval-shape, tilting, etc. The frame 144 is supported on an arm 148 that may be raised or lowered relative to the stand 146. The stand 146 is extremely sturdy to support up to 500 lbs of weight on the frame 144, and preferably includes a grab handle 150. Although not shown, wheels may also be provided.

As seen in FIG. 11C, the sleeping platform 142 and frame 144 may be rotated about a vertical axis, preferably up to 15° in either direction. This provides greater flexibility for the mother in optimally positioning the sleeping platform 142 for easy access. This is particularly useful if the sleeping platform 142 is a rectangular shape with one linear wall being convertible, so that the entire stand 146 need not be moved to angle the convertible wall to directly face the mother.

Figure 12A:
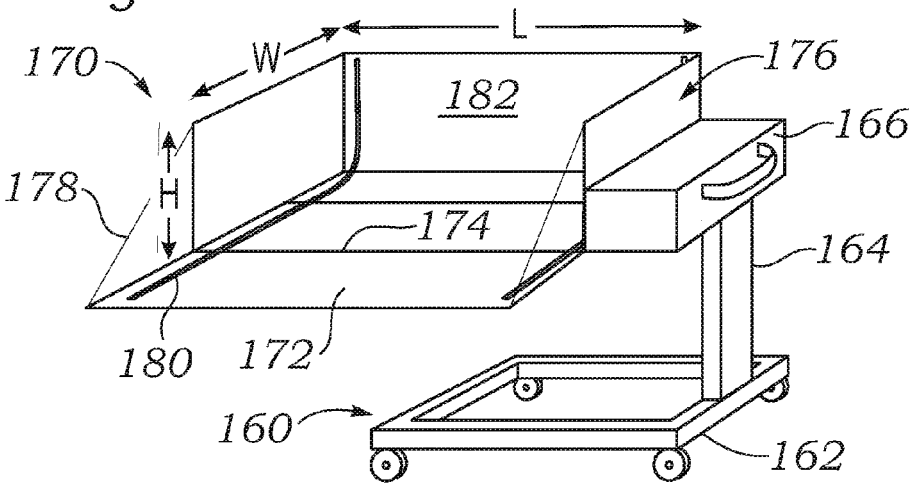
FIGS. 12A-12C are perspective views of alternative over-the-bed bassinets each mounted on a stand including a base on wheels.
Figure 12B:
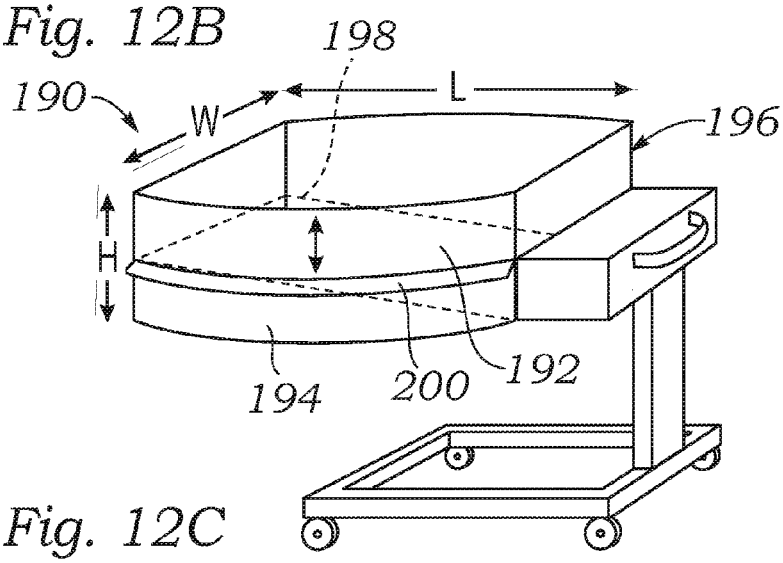
Figure 12C:
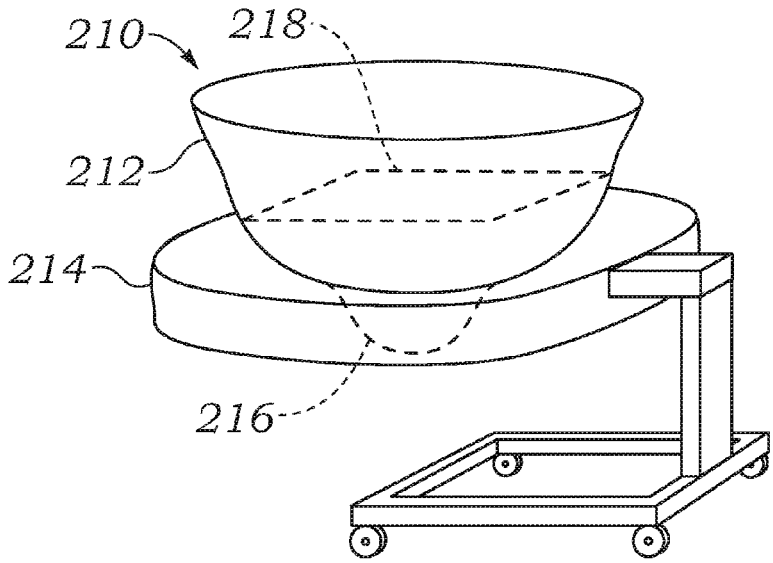

FIGS. 12A-12C are perspective views of alternative over-the-bed bassinets each mounted on a stand 160 including a base 162 on wheels 164. In addition to the portable stand 160, each of the bassinets in FIGS. 12A and 12B also includes a small drawer 166 for storing baby care items, for example. This illustrates one possibility for combining the over-for-bed bassinets having convertible walls described herein with a variety of complementary structures. For instance, the top surface of the drawer 166 can function as a small table or platform for preparing of baby medicaments, for example. Later in the application, a sliding shelf is shown in conjunction with another version. The present application contemplates the combination of any number of these options.

FIG. 12A illustrates a bassinet 170 having a convertible front wall 172 that pivots about a bottom edge 174 away from the other walls of a rectangular bassinet enclosure 176. In the illustrated embodiment, a strap or cable 178 connects between the top outer corners of the front wall 172 and to the upper edge of the sidewalls of the enclosure 176. The cable 178 may be non-extensible and pass into a channel to connect to a spring-loaded mechanism for returning the front wall 172 to its vertical orientation. Alternatively, the cable 178 may be an elastic strap which simply connects to a point on the enclosure 176 and provides the restoring force when stretched.

The bassinet 170 also includes tracks or rails 180 that extend along the floor of the enclosure 176 and continue in line across the bottom edge 174 and up the front wall 172. A sleeping platform (not shown) for the baby may be mounted on the carriage capable of sliding on the rails 180. When the front side 172 is lowered by the mother, as shown, the sleeping platform may move along the rails 180 to bring the baby closer to the mother. The rails 180 are shown also extending up the rear wall 182, which can also be convertible and provides left- and right-handed options for opening the enclosure 176. Preferably, the sleeping platform carriage features a return mechanism which causes the carriage to move back to the central position within the enclosure 176 in the absence of any barrier to such movement. For example, the mother may slide the sleeping platform toward her and rest her arms on it while feeding the baby, but when she lifts her arms the platform slides back into the central position. When the sleeping platform returns to its central position, the front wall 172 can return to its upright orientation; again, upon removal of any barrier to such movement.

FIG. 12A illustrates exemplary dimensions for a bassinet enclosure, given as the length L, the width W, and the height H. These dimensions may vary, as the reader will understand. One suitable set of dimensional ranges includes a length L of between 25-30 inches (~63-77 mm), a width W of between 14-17 inches (~35-43 mm), and height H of between 9-11 inches (~19-28 mm). Exemplary dimensions include a length L of about 27.25 inches (~69 mm), a width W of about 15.5 inches (~39 mm), and a height H of about 9.5 inches (~24 mm).

In FIG. 12B a bassinet 190 includes a front side 192 that may be lowered into a sleeve 194 (schematically shown) by the mother, as indicated by the double-headed arrow. The corner-to-corner dimensions of the enclosure 196 are again indicated by the symbols H, W and L, which may be similar to those described above. However, the area of the enclosure 196 is somewhat larger than the rectangular enclosure 176 of FIG. 12A because the front and rear sides are outwardly convex. The convex front side 192 complicates pivoting about its curved lower edge, and thus a vertical sliding movement is preferred.

FIG. 12B also shows a tilted sleeping platform 198 that enables the mother to access the baby easily but provides a portion of the enclosure that remains intact. That is, the baby may be positioned with its head at the higher end of the sleeping platform 198 so that the mother can initiate breast-feeding more readily. However, the lower end of the sleeping platform 198 remains below the level of the non-moving sleeve 194 such that a portion of the sleeping platform is always bounded by a partial wall on the front side. Rounded contours on the enclosure 196 as well as a lip 200 at the upper edge of the sleeve 194 add ergonomic comfort to baby and mother.

FIG. 12C illustrates a different form of bassinet 210 comprising a bowl 212 that can be tilted by the mother, as opposed to having movable walls. The bowl 212 nests within a central aperture of a foam donut 214, preferably about 3 inches (~8 mm) thick. The bowl 212 may feature a lower protuberance 216 that extends into the aperture of the donut 214 for stability. Furthermore, the aperture in the center of the donut 214 may include a Velcro liner, with the bottom of the bassinet bowl 212 being covered in mating Velcro so the bassinet stays secure in the middle of the foam. A sleeping platform 218 mounts midway up the interior of the bowl 212.

The mother accesses the baby by leaning on the bowl 212, which includes a wall that tapers outwardly and flares out at the top for ergonomic comfort. The bowl 212 tilts and compresses the foam donut 214. When the mother removes her arms from the baby, the foam donut 214 expands and returns to its normal shape, restoring the wall of the bowl 212 back to its upright position. When viewed from above, the bowl 212 may be circular, though an oval-shape that better fits the elongated shape of the baby is preferred. If oval-shape, the central aperture in the donut 214 is also preferably oval and the bowl 212 is predisposed to tilt in either direction about a single horizontal axis.

In the embodiment of FIG. 12C there are no relatively movable enclosure walls; rather the sidewalls of the bowl 212 have a fixed shape, and the entire bowl pivots. This is similar to other embodiments described herein, though the pivoting mechanism is different. A distinction can be made between a convertible front wall that moves between raised and lowered positions relative to the other walls of the enclosure, and a front wall that moves with the entire enclosure. In either case the front wall in its raised position presents a barrier to an infant rolling off the sleeping platform, whereas the barrier is substantially removed in the lowered position. The sleeping platform desirably remains horizontal (or tilted, if so oriented), though some tilt toward the mother such as in the embodiment of FIG. 12C is acceptable.

Figure 13B:
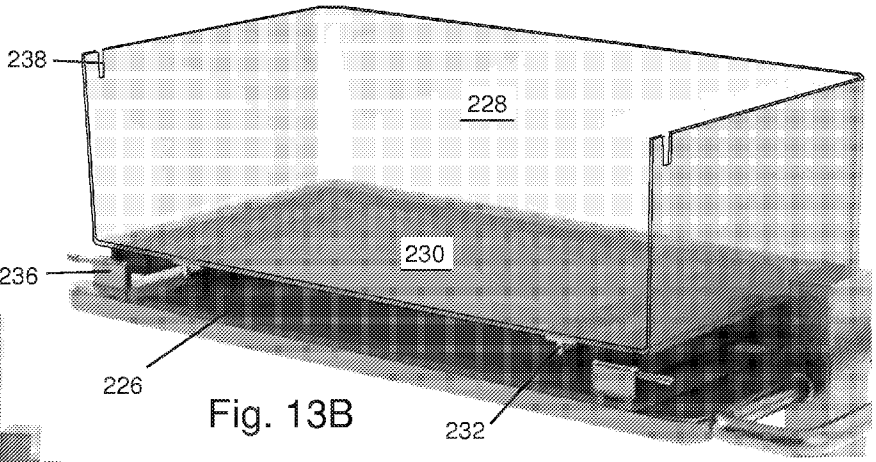
FIGS. 13A-13C are perspective views of another over-the-bed bassinet mounted on a stand including a non-wheeled base and having a convertible front wall arranged to slide underneath the bassinet.
Figure 13C:
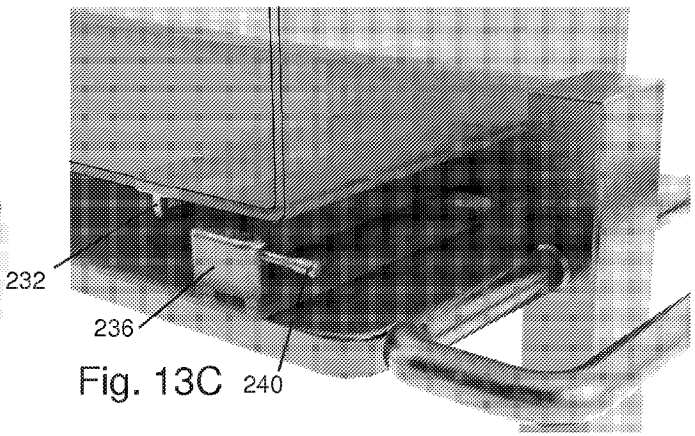
Figure 13A:
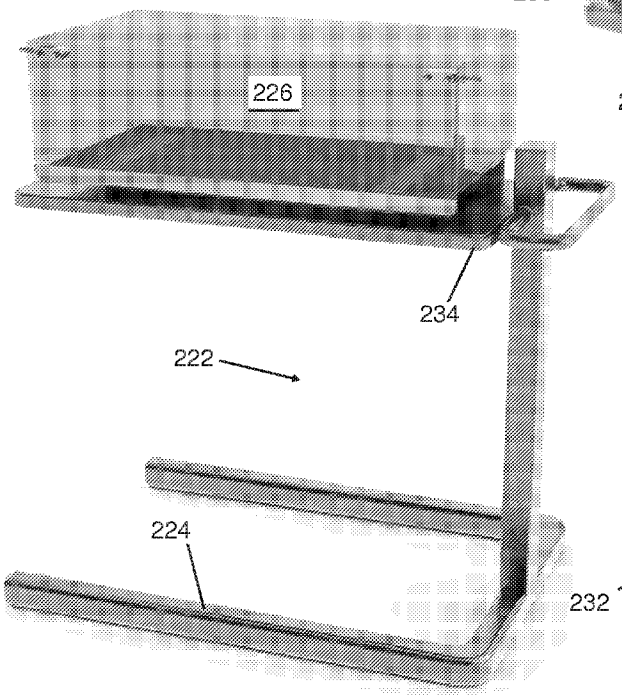

FIG. 13A shows another over-the-bed bassinet 220 mounted on a stand 222 including a non-wheeled base 224 for greater stability. A front wall 226 converts from a vertical orientation forming a portion of a transparent bassinet enclosure 228, and a horizontal orientation underneath a floor 230 of the bassinet, as seen in FIG. 13B. Various mechanisms may be utilized to provide this under-the-bassinet front wall 226, including a pair of metal slides 232 mounted under the floor 230, as best seen in FIG. 13C. Although not shown, a lower edge of the front wall 226 includes carriages mounted for movement on slides 232. A table 234 supports the bassinet 220 and provides a surface on which the front wall 226 rests when under the floor 230.

The front wall 226 includes a pair of latch members 236 that engage slots 238 in the sides of the bassinet enclosure 220. As best seen in the detail of FIG. 13C, the latch members 236 may have a locking pin 240 the fits within the slots 238, in which case the front wall 226 is merely lifted out of slots and pivoted downward underneath the bassinet 220. Other latches such as magnetic contacts, Velcro, spring-loaded detents, etc., may also be used.

Figure 14:
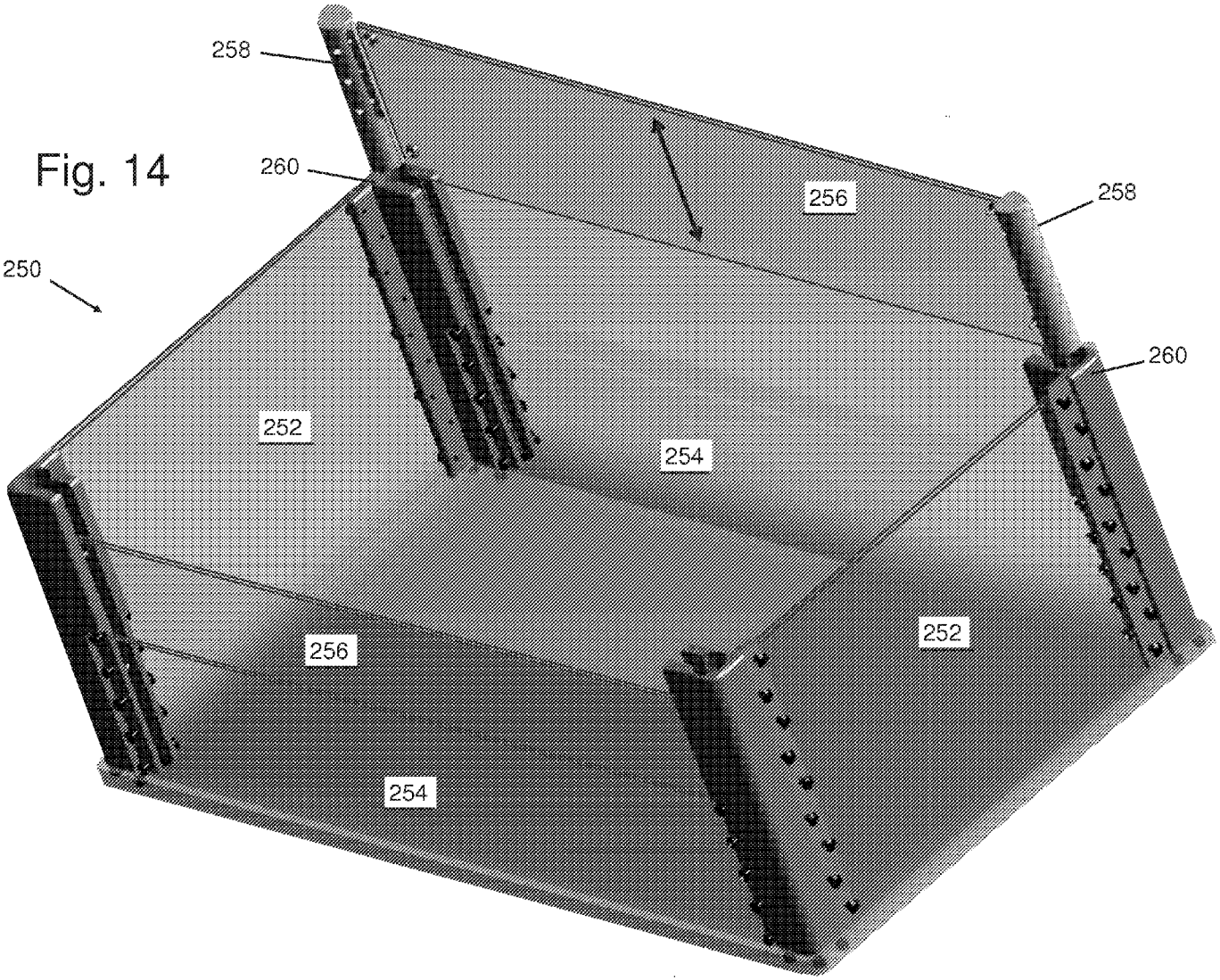
FIG. 14 is a perspective view of a bassinet frame showing a spring/shock mechanism for convertible walls thereof.
Figure 15:
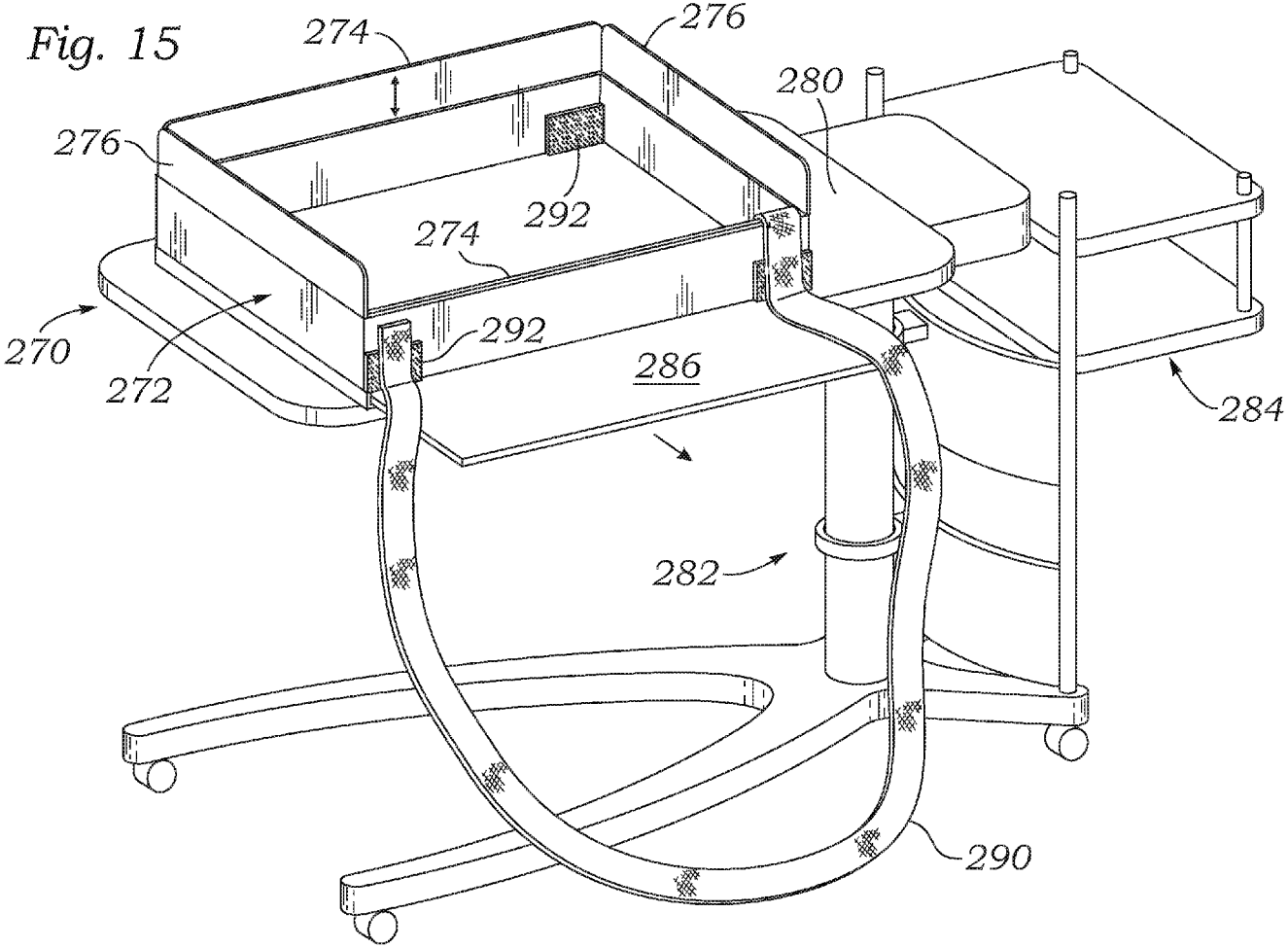
FIG. 15 is a perspective view of a further over-the-bed bassinet on a stand including a base on wheels and having a detachable strap for securing the bassinet to a mother during breast-feeding.

FIG. 14 is a perspective view of a bassinet frame 250 showing a spring/shock mechanism for convertible walls thereof. More particularly, the frame 250 includes a non-moving enclosure component comprising tall sidewalls 252 and front and rear half walls 254. A sleeping platform (not shown) resides within the enclosure approximately at the height of the top edge of the half walls 254. Front and rear convertible walls 256 are mounted to slide up-and-down adjacent the half walls 254. As seen exploded, each convertible wall 256 terminates at either end in a cylindrical column 258 that slides vertically within a cylinder cavity provided in a corner member 260. Although not shown, each cylindrical column 258 is preferably hollow and houses a coil spring to provide the restoring force when any barrier to upper movement is removed. Additionally, a damping mechanism such as a shock absorber (not shown) is preferably provided within the cylindrical cavities of the corner members 260. In this embodiment, whose principles can be applied to any of the bassinets described herein, the front and rear convertible walls 256 may be depressed downward within the cavities of the corner members 260, and when released are biased upward toward their original position. The damping mechanism prevents a sudden upward movement of the walls 256. The walls 252, 254 are desirably transparent to permit greater visibility FIG. 15 shows an over-the-bed bassinet 270 with a number of convenient features that may also be used in any of the other embodiments described herein. First of all, the bassinet 270 with enclosure 272 having at least one (and preferably two) convertible wall 274. In the illustrated embodiment, the enclosure 272 is rectangular and has a lower half that is non-moving, two non-moving sides 276 on an upper half, and front and rear convertible walls 274. Preferably, a sleeping platform within the enclosure 272 raises the baby to just below the level of the lower non-moving sides. As described above, the walls 274 descend vertically downward into slots or pockets provided in the lower half of the enclosure 272. Also, the walls 274 are biased upward so as to return to their original upright position in the absence of any barrier to such movement.

The bassinet 270 rests on a table support 280 extending horizontally from a stand 282 on wheels. The stand 282 has the traditional over-the-bed configuration, and may be vertically adjustable. On one end of the stand 282, a series of convenient shelves 284 are also provided. Furthermore, a sliding shelf 286 stores under the bassinet 270 and may be pulled out on one or both front and rear sides as shown.

FIG. 15 also shows a strap 290 removably attached to opposite front corners of the bassinet 270. In the embodiment shown, the bassinet enclosure 272 includes a number of Velcro patches 292 to which complementary Velcro patches (not shown) on the strap 290 adhere. Specifically, patches are included on the exterior and interior front and rear corners of the non-moving lower portion of the enclosure 270. The strap 290 attaches as shown, adhering first to an exterior patch 292 on the left, looping around the mother, attaching to an exterior patch on the right, and then extending over the lip of the enclosure 272 and over the front wall 274 in its lowered position to adhere to the interior patch 292 on the right. In this position, the strap 290 not only holds the front side 274 down on the right when the mother is feeding the baby, thus freeing her hands to hold the baby in proper position, it also secures the mother to the bassinet, and prevents the bassinet from moving away from her. The strap 290 may be attached using other devices than Velcro, such as snaps, magnets, snap hooks, plain hooks, etc.

Convertible bassinets described herein having a strap such as that shown in FIG. 15 function slightly differently than those without. Without the strap, if the mother falls asleep she will likely release the baby and the convertible wall will rise upward when she takes her arms away from it. Until she takes her arms away, she remains close and her body presents a barrier to the baby falling out. The strap 290 fastens the mother to one side of the bassinet, and she then creates a barrier that prevents the baby from falling out. The mother preferably uses this security device when she is feeding the baby. By securing the mother to the bassinet, it is much easier for the mother to feed her baby, no matter what size or shape the mother is. Furthermore, the strap 290 prevents the bassinet on wheels from moving away from the bed. The convertible wall 274 remains lowered because one side (the right side in the drawing) of the strap 292 extends thereover and secures to an interior Velcro patch 292. However, while the strap 292 remains attached the mother continues to present a barrier to the baby falling out of the bassinet 270. When the strap 290 is removed by the mother, she no longer present a barrier to the baby falling out, but the convertible wall 274 rises upward. To ensure the right side of the strap is detached, one side may be permanently affixed to the exterior of the bassinet, while the other is detachable.

FIGS. 16-19 show a still further bassinet 300 having a convertible wall 302 mounted on a frame that pivots about a central longitudinal axis 303 of the bassinet, under a sleeping platform 304. In the illustrated embodiment, the wall 302 is arcuate and arranged to pivot or roll underneath the sleeping platform 304. There may be two separately moveable walls 302, or the two walls may be connected for simultaneous movement.

Figure 16A:
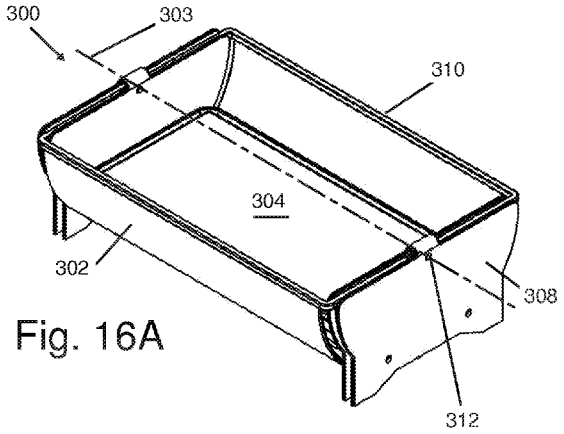
Figure 16B:
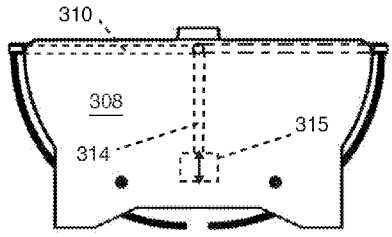

With reference to FIGS. 16A-16C and FIGS. 19A-19D, the bassinet 300 defines a generally rectangular enclosure surrounding the sleeping platform 304 including two non-moving end walls 308 and two long convertible walls 302. The convertible walls 302 have an arcuate sheet-like configuration and edges of the side wall 308 mirror the curved shape for a distance, as seen in FIG. 16B. The convertible walls 302 rotate underneath the sleeping platform 304, as seen in the sequences of FIGS. 16A-17A-18A and 16B-17B-18B. Each wall 302 mounts on a U-shaped frame member 310 that pivots about an axis through the end bolts 312 seen in the figures. Furthermore, centering arms 314 having a weight 315 thereon connect to the frame members 310 to provide a restoring force to the walls 302, biasing them to their raised positions. As seen in FIGS. 16B-18B, the centering arms 314 depend downward to the weight 315 from the pivot point 312 generally at right angles to the frame member 310. Displacing the centering arms 314 from vertical creates a restoring force to the assembly. Preferably, the end walls 308 include two panels between which is a narrow space for movement of the frame members 310 and centering arms 314. Desirably, there are two centering arms 314 for each frame member 310, one on each end of the bassinet 300 for symmetry.

Figure 17A:
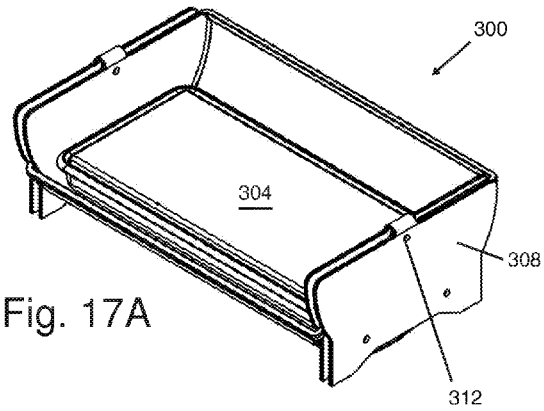
Figure 17B:
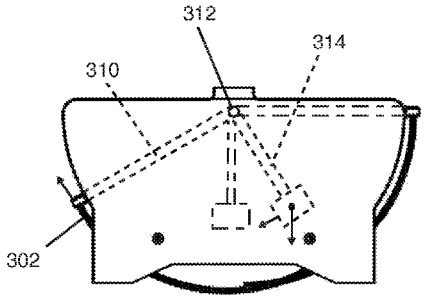

FIG. 16B shows the two walls 302 in their raised positions with the weighted centering arms 314 hanging straight down from the pivot point of the end bolt 312. FIG. 17B shows the left-hand wall 302 pivoted down, or CCW, such as when the mother leans on the top edge of the wall. The centering arm 314 is raised up above its point of equilibrium, and now exerts a force from gravity as shown by the arrows, tending to return the assembly and wall 302 to its original position. The restoring force will be less than the mother's arm weight, but large enough to raise the wall in the absence of small barriers against such movement (e.g., a blanket). Finally, both walls 302 are shown pivoted down in FIG. 18B, with the centering arms 314 of both exerting restoring forces. This configuration may not be very common, as the mother only accesses the bassinet 300 from one side at a time, though the separate movement of the two walls enables access from either side. Moreover, locks may be provided to retain the walls 302 in their lowered position to clean the bassinet 300, for example.

Although separately moving walls 302 are shown in the figures, the walls could be provided on a single arcuate sheet with a rectangular frame member 310 that extends the width of the bassinet 300. Such a design would only require one centering arm 314 on each end of the bassinet 300. Downward movement of one wall 302 would raise the opposite wall. Though this configuration simplifies the construction, the fact that the opposite wall raises up is a disadvantage. In one embodiment, the arcuate walls 302 are formed of a thin polymer such as polypropylene or nylon, while the frame members 310 and weighted centering arms 314 are made of a suitable metal such as aluminum or steel for strength.

Figure 18A:
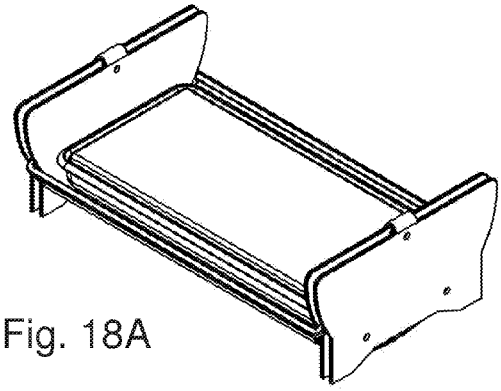
FIGS. 18A-18B are perspective views of the bassinet in FIGS. 16A-16C with both convertible walls shown underneath a sleeping platform.
Figure 18B:
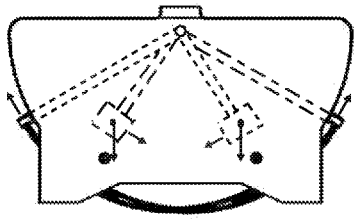

FIGS. 19A-19D show further details of the bassinet 300. The sleeping platform 304 is shown mounted between the end walls 308 and elevated above the feet 316 thereof to provide a space underneath for retraction of the convertible walls 302. The two arcuate walls 302 are desirably slightly offset in size so that instead of interfering they overlap and one moves over the other, as seen in FIGS. 17B and 18B.

The restoring force of the bassinet 300 of FIGS. 16-19 is from the weight 315 on the centering arms 314. This greatly simplifies the mechanism and may be calibrated by moving the weight 315 on the arms 314 up or down, as indicated in FIG. 16B. Other configurations are possible, however, including spring designs as shown previously, and more complicated mechanical or pneumatic systems.

FIG. 17C shows a strap 320, such as was described above with reference to FIG. 15, that can be attached to the bassinet 300 for added security. The strap may have a fastener on either end that mates with outside fasteners 322 and/or inside fasteners 324 on the bassinet 300. The fasteners may take a variety of forms, such as Velcro, snaps, magnets, snap hooks, plain hooks, etc. One particularly useful arrangement is to provide slots on either panel of the end walls 308 and mating Velcro fasteners on the strap itself. The mother has the option of attaching the strap 320 outside or inside the end walls 308. If attached inside, the strap 320 acts as a barrier to upward movement of the wall 302, and thus frees up the mother's hands. If attached on the outside, however, the walls 302 are free to move. Preferably, the mother attaches only one side of the strap 320 to the inside such that upon removal thereof the wall 302 returns to its raised position. As explained above, one end of the strap 320 may be non-detachably affixed to the outside of the end wall 308 on one side to prevent restraining the convertible wall 302 on both sides.

Figure 21:
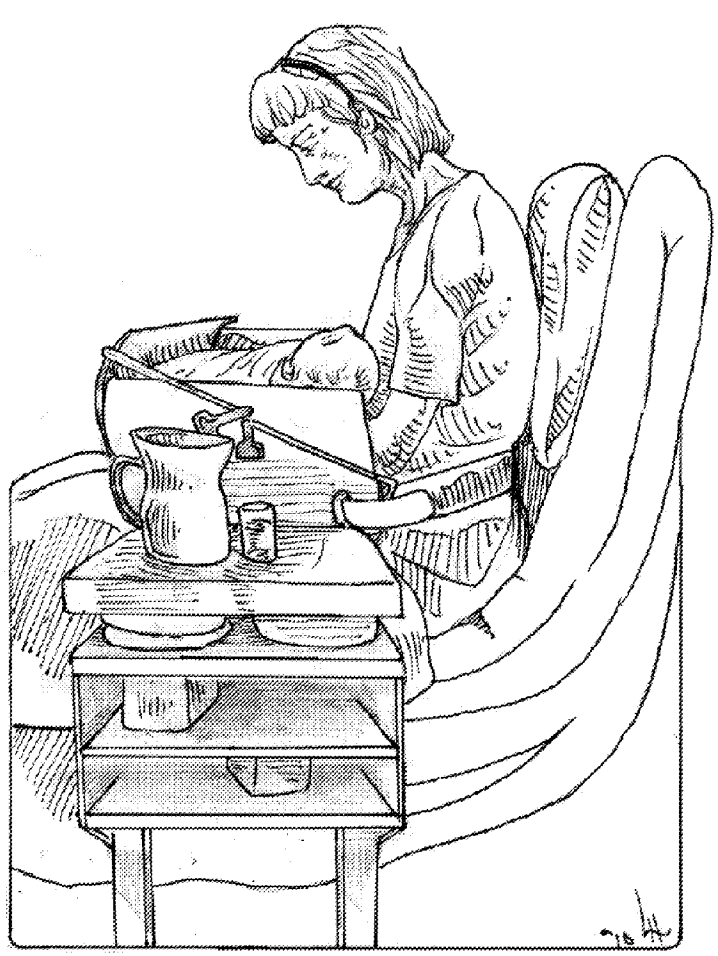
FIG. 21 is a rendering of a mother on a bed shown breast feeding a baby positioned within an over-the-bed bassinet with a convertible front wall.
Figure 20:
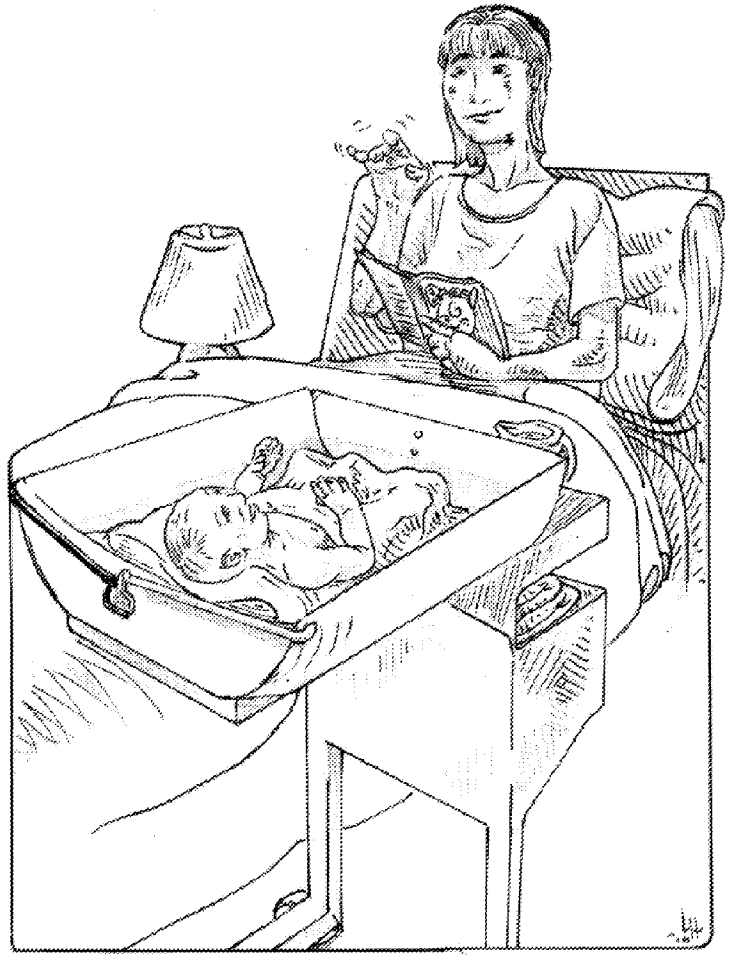
FIG. 20 is a rendering of a mother on a bed showing a baby positioned within an over-the-bed bassinet described herein.
Figure 22:
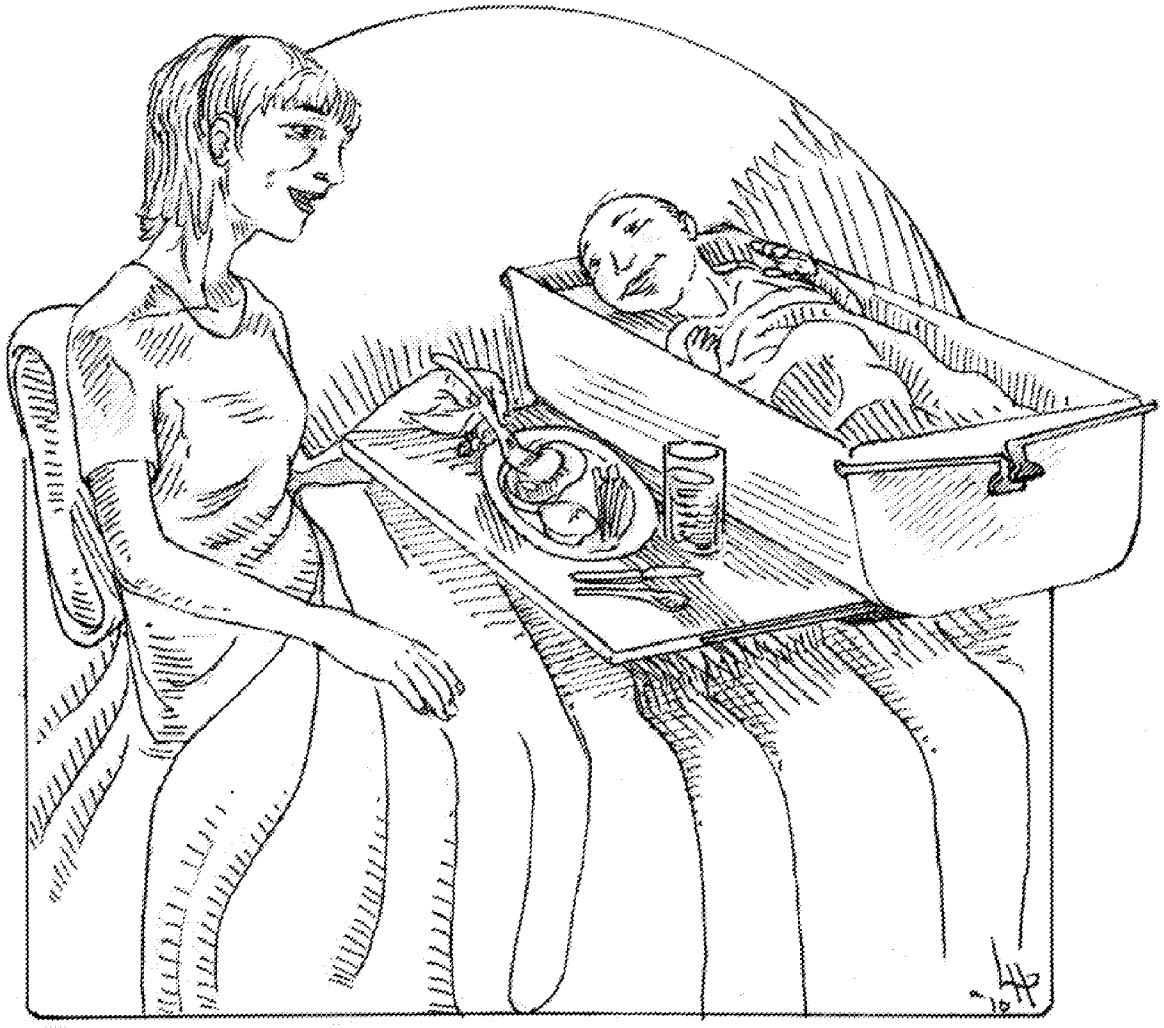
FIG. 22 is a rendering of a mother on a bed showing a baby positioned within an over-the-bed bassinet having a pull-out shelf underneath so as to function as a dual bassinet and food tray.

FIG. 20-22 are depictions of a mother on a bed showing a baby positioned within an over-the-bed bassinet similar to that shown in FIGS. 16-19 in various configurations. First, FIG. 20 shows the bassinet adjacent to the bed with the baby safely ensconced. All of the walls remain upright as in a standard bassinet. The over-the-bed design permits the mother to bring the bassinet up close without removing the baby therefrom. FIG. 21 is a rendering of a mother on a bed shown breast feeding a baby positioned within the bassinet with a convertible front wall lowered. The front wall comprises a portion of a curved wall that extends on both sides of the bassinet, and pivots downward when the mother wants to reach in and feed the baby. The reader will notice that in this embodiment the front wall curves under the entire bassinet to the other side, and there is only one moving frame, so that the opposite side rises upward. The strap is shown securing the bassinet to the mother, which prevents the bassinet from rolling away and also secures the mother as a barrier against the bassinet to prevent the baby from falling between the bed and mother. Finally, FIG. 22 is a rendering of a mother on a bed showing a baby positioned within the over-the-bed bassinet, with a shelf pulled out from underneath so as to function as a food tray. This greatly reduces clutter within the maternity room by eliminating the need for a separate food tray.

The bassinets described herein are designed to allow the mother easy access to her infant to feed while in bed. A mother does not decide to fall asleep in bed holding her newborn, however there are many reasons why this situation occurs. Primarily a mother falls asleep holding her newborn because of exhaustion, caused by her labor and delivery experience, which may include the use of medication that will make her sleepy. What's more, she may have had a C-section, or a post partum tubal ligation, which included anesthesia, resulting in increased sleepiness. Exhaustion will cause her to fall asleep while she is feeding her baby, and the release of prolactin during breastfeeding will also cause drowsiness. If, in a sleep state, the mother moves her arms, the convertible portion of the barrier will move toward its elevated position, and the baby will remain safely in the bassinet. In one embodiment, the convertible side automatically rises at least two inches, creating a protective barrier to prevent the infant from falling out of the bassinet.

The bassinet described herein designed for the postpartum hospital stay allows a mother to easily visualize and access her newborn, without having to get out of bed. The bassinet promotes infant safety, and supports the mother and those caring for the newborn, in preventing back and neck injuries. The concept has been endorsed by providers and professionals in the field.

Nurses and nurse managers who oversee large postpartum units and who have been interviewed have expressed a desire to have access to a safer bassinet, such as described herein. Hospital risk managers and biomedical engineers have emphatically endorsed the need for such a solution. Hospitals are naturally concerned about the safety of the newborns that are born in their institutions, and are continually looking for ways to insure and improve the positive outcomes for infants. A product that allows mothers to put their babies to bed easily and not have to get up when they are exhausted or medicated, can alleviate a mother's anxiety, and reduce the stress placed on the nurses who try to enforce mother's putting their infant's back to bed. A nurse is often responsible for up to 8 mothers and babies, and cannot oversee the babies every minute of the day while they are in the hospital, so providing a safer bassinet can be extremely useful.

While the invention has been described in its preferred embodiments, the words which have been used are words of description and not of limitation. Therefore, changes may be made within the appended claims without departing from the true scope of the invention.

What is claimed is:

1. A bassinet, comprising:

a frame on which is mounted a sleeping platform surrounded by an upstanding enclosure including walls that present a protective barrier to an infant rolling off of the sleeping platform, a convertible wall being convertible between an elevated position and a lowered position in which the barrier on that side is lowered, the convertible wall being mounted in the bassinet with a restoring mechanism that causes the convertible wall to automatically return toward the elevated position from the lowered position in the absence of a barrier to upward movement.

2. The bassinet of claim 1, wherein the convertible wall remains oriented substantially vertically and translates up and down when converting between the elevated and lowered positions.

3. The bassinet of claim 1, wherein the convertible wall pivots outward about a bottom edge when converting between the elevated and lowered positions.

4. The bassinet of claim 1, wherein the convertible wall rotates downward under the sleeping platform when converting between the elevated and lowered positions.

5. The bassinet of claim 1, wherein the restoring mechanism comprises a spring mechanism that biases the convertible wall toward the elevated position from the lowered position.

6. The bassinet of claim 4, wherein the convertible wall has an arcuate shape that curves under the sleeping platform.

7. The bassinet of claim 1, including a strap having fasteners at either end for attaching to mating fasteners on the bassinet on either side of the convertible wall, wherein at least one of the fasteners on the bassinet causes the strap to pass over the convertible wall and present a barrier to upward movement from the lowered position thereof.

8. The bassinet of claim 1, wherein the sleeping platform and upstanding enclosure are rotatably mounted about a vertical axis with respect to the frame.

9. A bassinet that provides ergonomic support for a mother while she is breast feeding her baby, comprising:

a stand including a base and an upstanding support member connecting an elevated frame above the base, the upstanding support member being connected to the elevated frame in such a manner that the elevated frame may be cantilevered over a bed;

a sleeping platform supported by the elevated frame; and an upstanding enclosure surrounding the sleeping platform including walls that present a protective barrier to an infant rolling off of the sleeping platform, a convertible wall being convertible between an elevated position and a lowered position in which the barrier on that side is lowered, the convertible wall mounts in the bassinet with a restoring mechanism that causes the convertible wall to return toward the elevated position from the lowered position in the absence of a barrier to upward movement, wherein the bassinet is able to support the mother's arms while resting on the convertible wall in the lowered position and nursing her baby on the sleeping platform, and wherein the convertible wall will tend to return toward the elevated position when the mother's arms are no longer resting on the convertible wall.

10. The bassinet of claim 9, further including a sliding shelf that retracts under the sleeping platform.

11. The bassinet of claim 9, wherein the convertible wall remains oriented substantially vertically and translates up and down when converting between the elevated and lowered positions.

12. The bassinet of claim 9, wherein the convertible wall rotates downward under the sleeping platform when converting between the elevated and lowered positions.

13. The bassinet of claim 9, wherein the restoring mechanism comprises a spring mechanism that biases the convertible wall toward the elevated position from the lowered position.

14. The bassinet of claim 9, wherein the restoring mechanism comprises a piston and cylinder arrangement attached to displace the convertible wall upward from its lowered position.

15. The bassinet of claim 9, including a strap having fasteners at either end for attaching to mating fasteners on the bassinet on either side of the convertible wall, wherein at least one of the fasteners on the bassinet causes the strap to pass over the convertible wall and present a barrier to upward rotation from the lowered position thereof.

16. A bassinet that provides ergonomic support for a mother while she is breast feeding her baby, comprising:

a stand including a base, an elevated frame, and an upstanding support member connecting the elevated frame above the base, the upstanding support member being connected to the elevated frame in such a manner that the elevated frame may be cantilevered over a bed;

a sleeping platform supported by the elevated frame; and an upstanding enclosure surrounding the sleeping platform including walls that present a protective barrier to an infant rolling off of the sleeping platform, the walls including opposite end walls and front and rear walls and at least the front wall being convertible between an elevated position and a lowered position in which the barrier on that side is lowered, and wherein the front wall pivots downward under the sleeping platform when converting between the elevated and lowered positions, wherein the front wall mounts in the bassinet with a restoring mechanism that causes the front wall to return toward the elevated position from the lowered position in the absence of a barrier to upward movement, and the front wall will tend to return toward the elevated position when the mother's arms are no longer resting on the front wall, wherein the bassinet is able to support the mother's arms while resting on the front wall in the lowered position and nursing her baby on the sleeping platform.

17. The bassinet of claim 16, wherein the front wall has an arcuate shape that curves under the sleeping platform.

18. The bassinet of claim 16, wherein both the front wall and the rear wall are convertible between an elevated position and a lowered position in which the barrier on that side is lowered, and both pivot downward under the sleeping platform when converting between the elevated and lowered positions.

19. The bassinet of claim 16, including a strap having fasteners at either end for attaching to mating fasteners on the bassinet on either side of the front wall, wherein at least one of the fasteners on the bassinet causes the strap to pass over the front wall and present a barrier to upward rotation from the lowered position thereof.

20. The bassinet of claim 16, wherein the restoring mechanism comprises a spring.

* * * * *